US012030703B2

(12) United States Patent
Jackson

(10) Patent No.: US 12,030,703 B2
(45) Date of Patent: Jul. 9, 2024

(54) WEARABLE PRESSURE CONTROLLED RELEASE DISPENSER DEVICE AND METHOD

(71) Applicant: Lorris Joseph Jackson, Larose, LA (US)

(72) Inventor: Lorris Joseph Jackson, Larose, LA (US)

(73) Assignee: Lorris Joseph Jackson

( * ) Notice: Subject to any disclaimer, the term of this patent is extended or adjusted under 35 U.S.C. 154(b) by 0 days.

(21) Appl. No.: 17/341,241

(22) Filed: Jun. 7, 2021

(65) Prior Publication Data

US 2021/0387785 A1 Dec. 16, 2021

Related U.S. Application Data

(60) Provisional application No. 63/037,865, filed on Jun. 11, 2020.

(51) Int. Cl.

*B65D 75/36* (2006.01)
*B65D 75/32* (2006.01)
*B65D 75/58* (2006.01)

(52) U.S. Cl.

CPC ..... *B65D 75/5811* (2013.01); *B65D 75/327* (2013.01); *B65D 75/367* (2013.01); *B65D 2575/3254* (2013.01)

(58) Field of Classification Search

CPC ..... B65D 75/5811; B65D 75/367; B65D 2575/3254; B65D 75/327

See application file for complete search history.

(56) References Cited

U.S. PATENT DOCUMENTS 3,792,799 A * 2/1974 Henfrey ..... A61J 1/1406 222/90
4,103,772 A * 8/1978 Wiegner ..... B65D 81/3211 206/222
4,174,035 A * 11/1979 Wiegner ..... B65D 81/3211 206/222
4,247,001 A * 1/1981 Wiegner ..... B65D 81/3222 215/DIG. 8
4,322,019 A * 3/1982 Smith ..... B65D 75/5872 141/330
4,785,931 A * 11/1988 Weir ..... B65D 51/2835 206/508
5,560,490 A * 10/1996 Chawla ..... B65D 75/327 206/530
6,443,307 B1 * 9/2002 Burridge ..... A61M 15/0061 206/532
8,443,970 B2 * 5/2013 Coon ..... B65D 51/2835 206/219
8,931,383 B1 * 1/2015 Hurwicz ..... B26D 7/0006 83/56
10,046,893 B2 * 8/2018 Janta ..... B65B 9/023

(Continued)

*Primary Examiner* — Frederick C Nicolas
(74) *Attorney, Agent, or Firm* — Lauren Rucinski

(57) ABSTRACT

The present invention is a pressure-controlled release dispenser. More particularly, the present invention relates to a blister pack with individual compartments that can contain a fluid, e.g., hand sanitizer, with a piercing mechanism within an individual compartment that enables pressure-controlled release of single use portions of the fluid contained therein. A blister pack of the present invention can also contain single use portions of dry flowable materials or solid materials.

11 Claims, 28 Drawing Sheets

(56) References Cited

U.S. PATENT DOCUMENTS

| | | | | |
|---|---|---|---|---|
| 11,273,099 | B2 * | 3/2022 | Selby | A61J 3/07 |
| 2003/0034271 | A1 * | 2/2003 | Burridge | A61M 15/0035 206/532 |
| 2004/0206773 | A1 * | 10/2004 | Ede | B65D 83/0463 222/83.5 |
| 2007/0005027 | A1 * | 1/2007 | Talamonti | A61J 1/2093 604/82 |
| 2011/0297580 | A1 * | 12/2011 | Nelissen | B65D 75/327 206/719 |

* cited by examiner

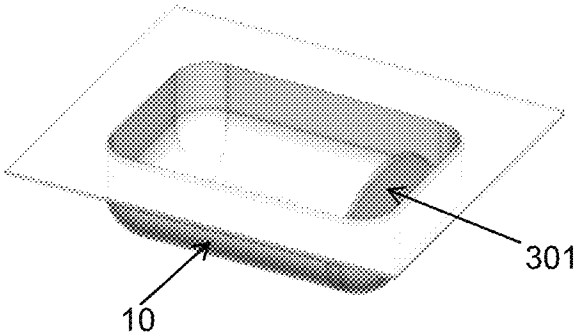
Fig. 9A
Fig. 9B
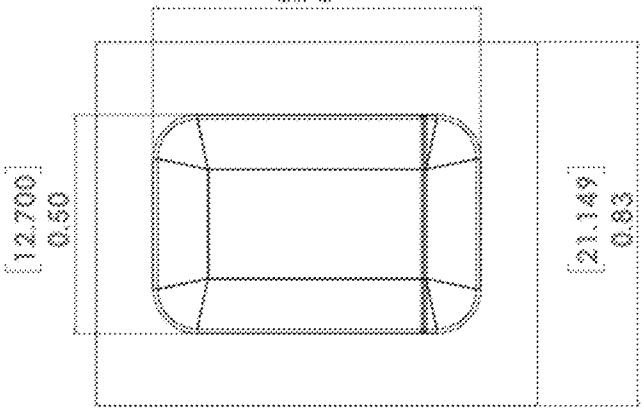
Fig. 9C
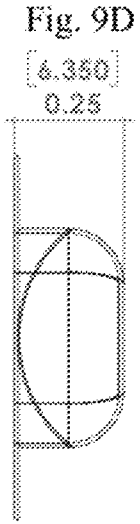
Fig. 9D
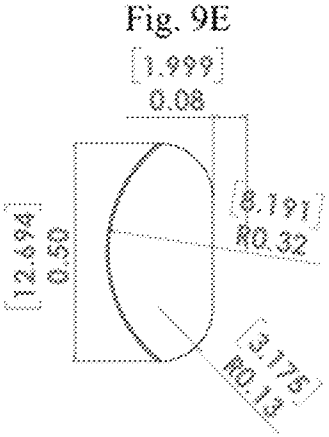
Fig. 9E
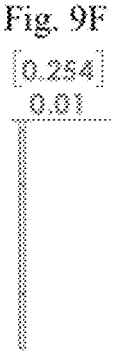
Fig. 9F Fig. 20A
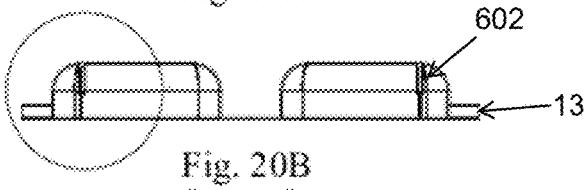
Fig. 20B
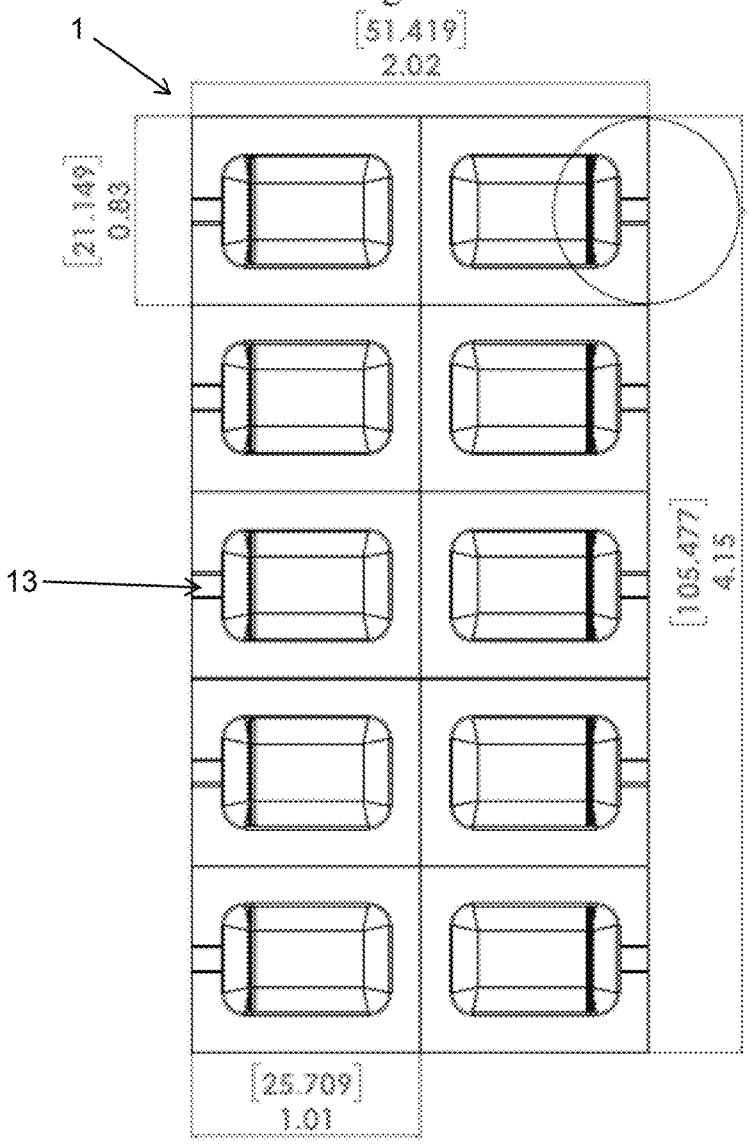
Fig. 20 C
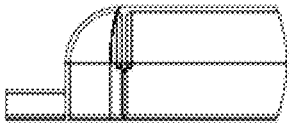
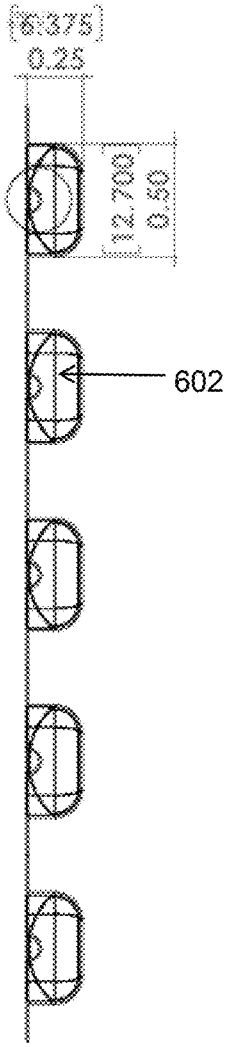
Fig. 20D

WEARABLE PRESSURE CONTROLLED RELEASE DISPENSER DEVICE AND METHOD

CROSS REFERENCE TO RELATED APPLICATIONS

This application claims priority to the U.S. Provisional Application No. 63/037,865 filed on Jun. 11, 2020 and entitled "Pressure Controlled Release Dispenser."

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

DESCRIPTION OF THE DRAWINGS

The drawings constitute a part of this specification and include exemplary embodiments of the Wearable Pressure Controlled Release Dispenser Device and Method which may be embodied in various forms. It is to be understood that in some instances, various aspects of the invention may be shown exaggerated or enlarged to facilitate an understanding of the invention. Therefore the drawings may not be to scale.

FIG. 6A is a top view of the dispenser or blister pack showing a punched hole to insert a lanyard clip through.

FIG. 9A is another perspective view of the embodiment in FIG. 4A.

FIG. 9B is a side view of the embodiment in FIG. 4A.

FIG. 9C is a top view of the embodiment in FIG. 4A.

FIG. 9D is a side view of the embodiment in FIG. 4A, which shows the front profile of the piercing member.

FIG. 9E is a back view of the piercing member of FIG. 9D.

FIG. 9F is a side view of the piercing member of FIG. 9D.

FIG. 20A is a side view of an embodiment of an individual compartment that can be included in one or more embodiments of a dispenser or blister pack of the present invention wherein the compartment comprises a slit through which liquid can flow and wherein the piercing member is circular.

FIG. 20B is a top view of a dispenser or blister pack with the compartment of FIG. 20A.

FIG. 20C is a side view of a dispenser or blister pack with the compartment of FIG. 20A.

FIG. 20D is another side view of a dispenser or blister pack with the compartment of FIG. 20A, which shows a detail of the piercing member.

BACKGROUND

Figure 1A:
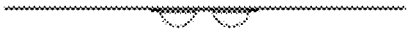
FIG. 1A is a side view of an embodiment of the invention with a lanyard.
Figure 1B:
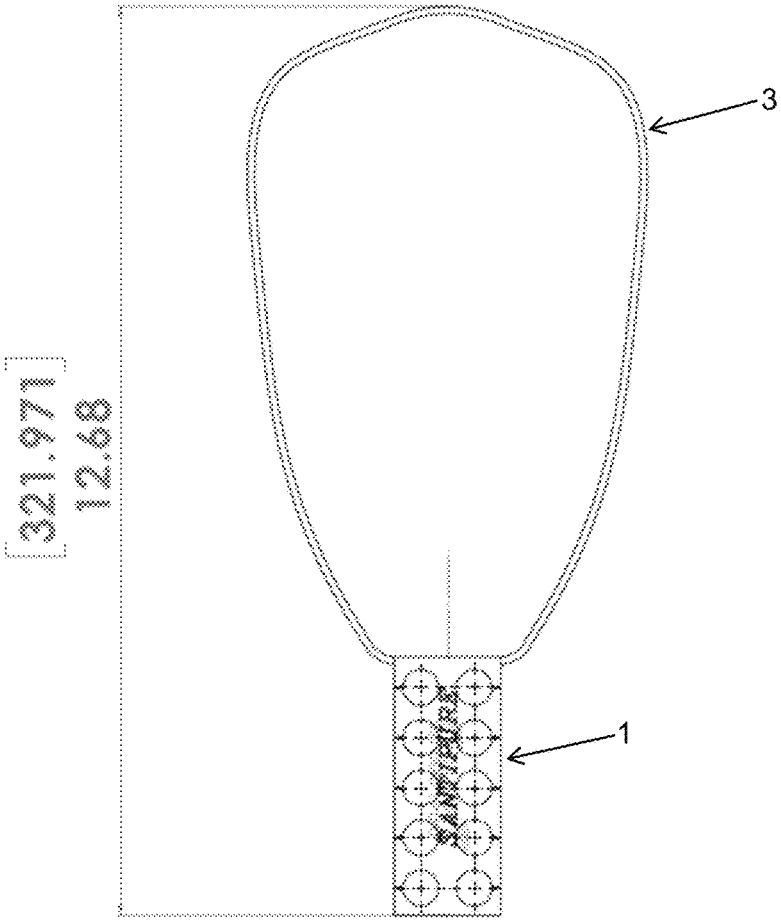
FIG. 1B is a front view of an embodiment of the invention with a lanyard.
Figure 1C:
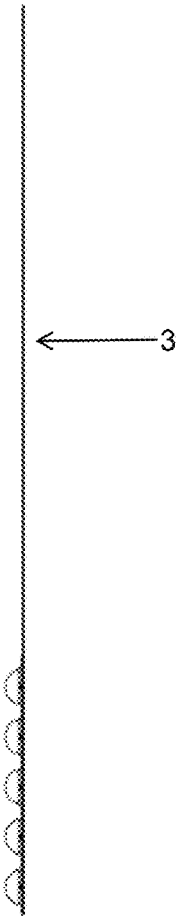
FIG. 1C is another side view of an embodiment of the invention with a lanyard.
Figure 2:
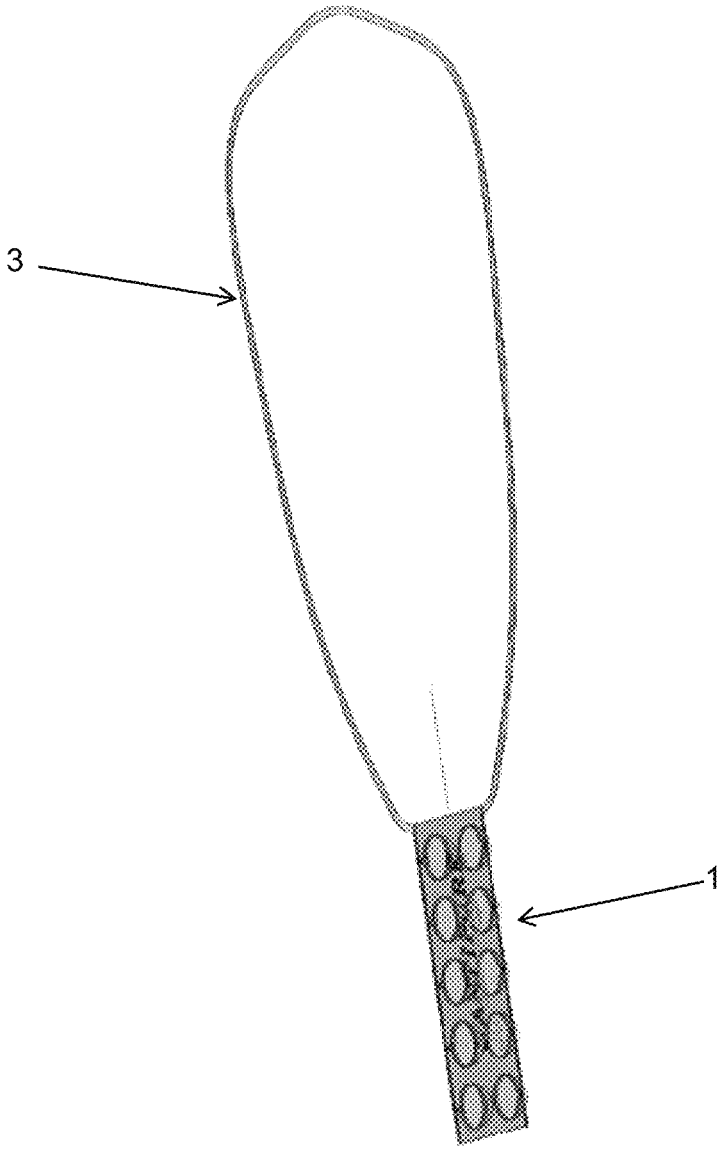
FIG. 2 is a perspective view of an embodiment of the invention with a lanyard.

There is a need in the art for a dispenser that is wearable by a user, and which can dispense single use portions of desired products that is a liquid, gel, or flowable solid, for a user.

Blister packs are known in the art for packaging solid materials, for instance, pills. However, any prior art blister pack is not effective at housing and dispensing liquids. This is because, the foil or covering that closes a typical blister is completely removed by the user to access to the solid contents. If a user were to attempt to remove a covering on a typical blister pack that contained liquid in the conventional manner, all of the liquid would undoubtedly spill out of the blister in the process.

Accordingly, there is a need in the art for a blister pack or dispenser that can effectively release single use portions of liquids or fluids for a variety of purposes including, single use hand sanitizing treatments, liquid or powdered medication, sunscreen, insect repellant, lotion or liquid makeup.

There is also a need in the art for a blister pack or dispenser that can effectively release single use portions of dry flowable materials, e.g., powdered medication or powdered sport drink mix and/or single use portions of more than one type of product or composition, e.g., epoxy resin and hardening agent. For similar reasons stated above for why current blister packs are inadequate for storing and dispensing liquids, storing and dispensing a powder or gel-like substance is technically infeasible using the prior art systems.

The apparatus and method of the present invention solves the problems confronted in the art in a simple and straightforward manner. Claimed herein is a dispenser, which can be a blister pack, with a pressure-controlled release mechanism in individual compartments that allows a user to dispense single use portions of a fluid or liquid (e.g., to sanitize the user's hands at any time and any place), or flowable dry materials (e.g., powdered medication). The pressure-controlled release mechanism is a piercing mechanism that is fixed within individual compartments of the dispenser or blister pack.

In embodiments that include hand sanitizer, these embodiments can help prevent the spread of bacteria and viruses that can easily spread from person to person. This can be part of a standard operating procedure for businesses to provide a dispenser or blister pack of the present invention to employees and/or customers for businesses that are looking to move forward in the current COVID-19 pandemic environment. Being able to put hand sanitizer in a packet and give it to customers to wear on their body will let others know how serious the company is about protecting the health and wellbeing of each customer.

In one or more embodiments, a dispenser or blister pack of the present invention can include more than one compartment with more than one type of product or composition that is kept separate in the individual compartments and with each compartment and product ready to use. In this embodiment, for example, one compartment can have an epoxy resin and another compartment can have a hardener. When opened and applied together, a complete epoxy can be obtained. This embodiment can also be used for medications that need to be separated before use and which can be given in exact specified amounts to ensure compliance.

In one or more embodiments, a blister pack of the present invention can be used to advertise. In these embodiments, preferably a blister pack is not perforated. An example of this is for blister packs containing hand sanitizer for use at football games. A team could easily buy custom packs with advertising to give out to fans at games to wear while in the stadium. Additionally, the cost of the sanitizer and enhanced blister pack could be reduced by advertising by other entities like law firms or businesses that wish to sponsor the team. Places and businesses that can potentially benefit from this embodiment are: airlines, cruise lines, trains, ferries, tour busses, long haul busses, casinos, amusement parks, museums, water parks, aquariums, zoos, professional sports teams, college sports teams, state fairs, festivals, concerts, conventions, resorts theaters and courtrooms.

In one or more embodiments, a dispenser or blister pack of the present invention can be filled with liquids or fluids or another desired material that is not hard enough on its own to break through the backing of the blister pack.

In one or more embodiments, a hole or opening is included along one end of a dispenser or blister pack, e.g., at a top portion of the pack, in an area that does not interfere with an individual compartment. A lanyard, tie, cord, or necklace of any kind can be inserted through the opening and tied to the pack and placed around a user's neck for easy use and accessibility. In other embodiments, a key ring or clip can be inserted through the opening for attaching the dispenser or blister pack on a user's clothing or a bag for example. This offers an improvement over the prior art for carrying, for example, hand sanitizer, which allows the materials to be at the user's finger tips rather than in a bag or storage area.

In one or more embodiments, a dispenser or blister pack is disposable with single use compartments. If hand sanitizer is included in the individual compartments, for example, this is beneficial given that the disposable dispensers of sanitizer can only be opened and used once and cannot be refilled with a cheaper or inferior solution.

In one or more embodiments, a larger sized compartment can hold contents for multiple uses. In one or more embodiments, a larger sized compartment with multiple chambers can hold contents for multiple uses, wherein each chamber can include a piercing member.

In one or more embodiments, a dispenser or blister pack can be filled with an exact amount of liquid or material allowed by the Federal Aviation Administration (FAA) to board a plane.

This invention offers many other improvements over the prior art, including, elimination of waste; reduction in manufacturing cost; and ease of use.

In one or more embodiments, a dispenser or blister pack of the present invention can be made without any perforations (depending on the desired application) so it can remain as one unit which can help to reduce litter. This embodiment can also help prevent blister packs or blister pack compartments from being a choking hazard. Being one whole unit can also help with custom advertising on packets.

In one or more embodiments, a dispenser or blister pack of the present invention includes a piercing plate or piercing member. Potential uses of a blister pack with piercing plate or piercing member include: 1) hand sanitizer; 2) liquid prescription medications; 3) powdered prescription; 4) medications; 5) perfumes; 6) moisturizers/lotions; 7) soaps; 8) insect repellant; 9) hobby paint; 10) glue; 11) sunscreen; 12) alcohol; 13) liquid or powdered vitamins; 14) cannabis tinctures; 15) powders; 16) granules; 17) soft gel capsules; 18) herbs or spices (e.g., in small amounts for meal planning services); 19) cooling extracts or oils; 20) gum; 21) seeds; 22) dog or cat treats; 23) ointments or creams; and/or 24) single use makeups or testers for makeup counters.

As can be seen, a dispenser or blister pack of the present invention can be used for numerous desired applications.

DETAILED DESCRIPTION

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies.

Turning to the figures, one or more embodiments of a dispenser of the present invention can resemble what is commonly referred to as a blister pack, which typically in the prior art contains compartments that house a pill or a vitamin. A prior art blister pack may have a foil base layer, for example, that a pill or vitamin can easily be pushed through when a user wishes to consume the pill or vitamin. As discussed, however, it has been considered impossible in the prior art to house a liquid in a blister pack.

Dispensers or blister packs 1 of the present invention include one or more piercing members 2, 201, 301, 401, 501, 601, 701, 801, 901, 202, 302, 402, 502 in individual compartments, and the piercing members enable the blister packs 1 to house a liquid in individual compartments 5, 501, 503 because without a piercing member, any product that is not hard enough to push out on its own would just smash or crush the plastic with no product coming out, or it would explode out of the packaging with product splashing everywhere. With the piercing member the amount of pressure put on the piercing member would control the opening of the back of the pack 1 thus allowing a controlled flow of the product. Various embodiments of piercing members are shown in the figures and labeled as 2, 201, 301, 401, 501, 601, 701, 801, 901, 202, 302, 402, 502.

In one or more embodiments, the piercing member has a continuous piercing member side wall with a periphery. A first fluid may be contained within the periphery of the continuous piercing member side wall and a second fluid can be contained within the compartment outside of the periphery of the continuous piercing member side wall.

A dispenser or blister pack 1 as shown in FIGS. 3B, 5B, 19C, 20B, 21C, for example, includes a plurality of individual compartments 5, 501, 503 that preferably can hold a single use portion of a desired material, e.g., a fluid or dry flowable material. The individual compartments 5, 501, 503 of a dispenser or blister pack 1 have a shape resembling a rectangle with rounded corners and/or surfaces 5 or as a circle 501.

In one or more embodiments, a dispenser or blister pack 1 also includes a plurality of individual compartments 5, 501, 503 that preferably can hold a single use portion of a desired material, e.g., a fluid, gel, or dry flowable material.

The individual compartments 501 of a dispenser or blister pack as shown in FIGS. 15A-15D have a circular shape or an at least substantially circular shape. Although not shown, individual compartments of a dispenser or blister pack of the present invention can also have other desired shapes, e.g., square, rectangular, irregular rectangular or square, oval, etc.

Figure 6A:
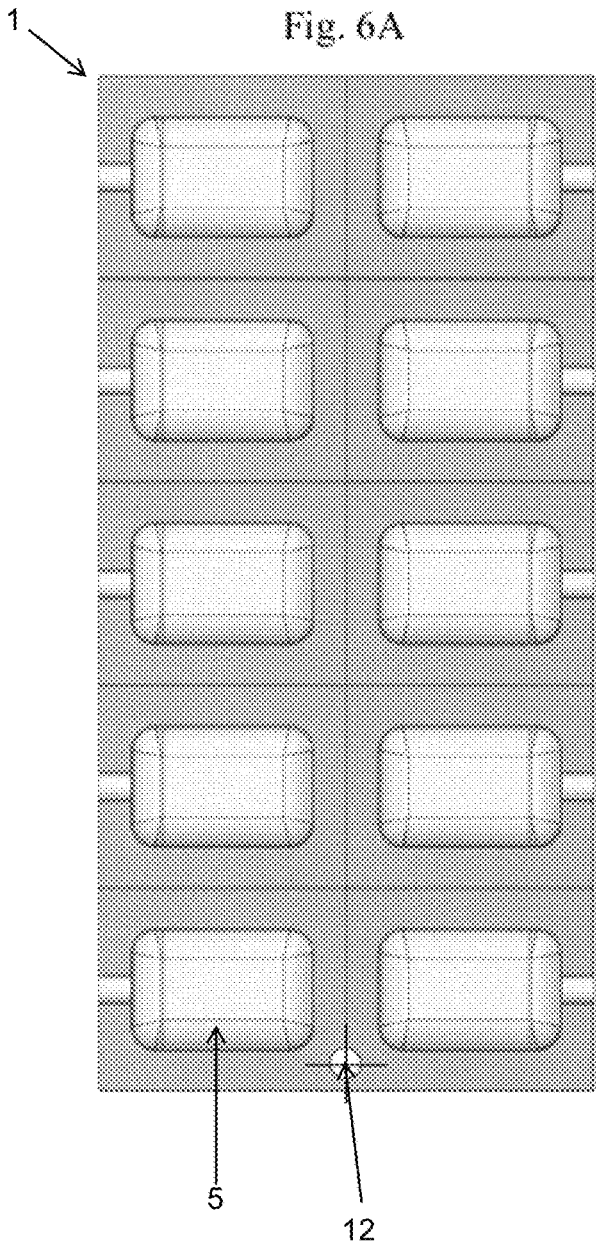
Figure 6B:
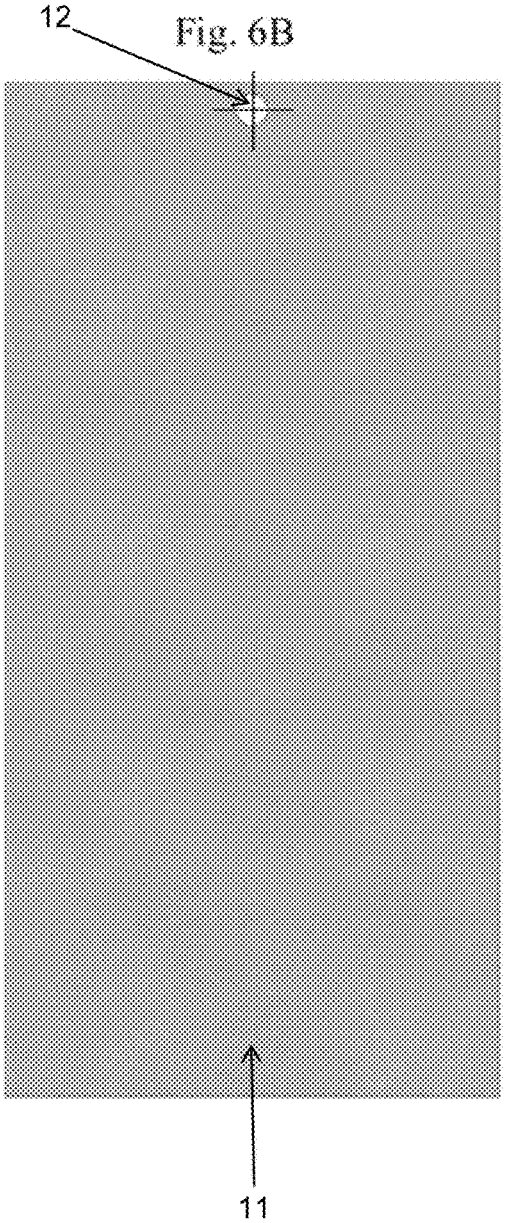
FIG. 6B is a back view of FIG. 6A.
Figure 6C:
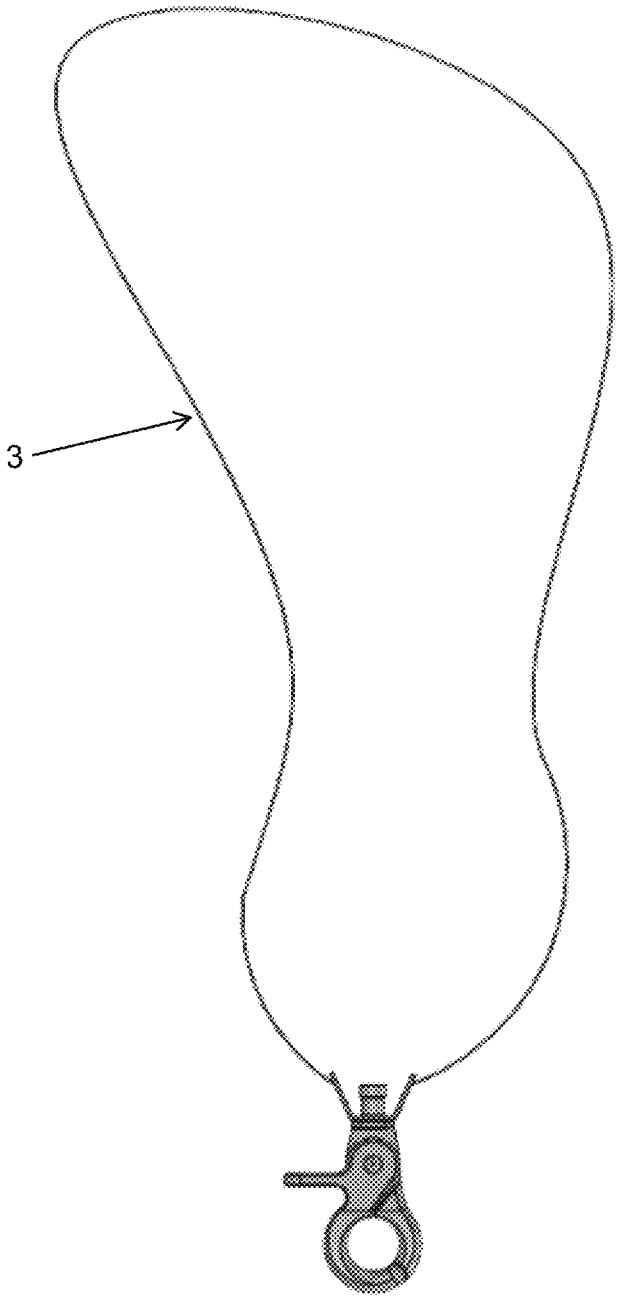
FIG. 6C shows one embodiment of a lanyard with a clip that can be inserted through the punched hole in FIG. 6A.
Figure 7:
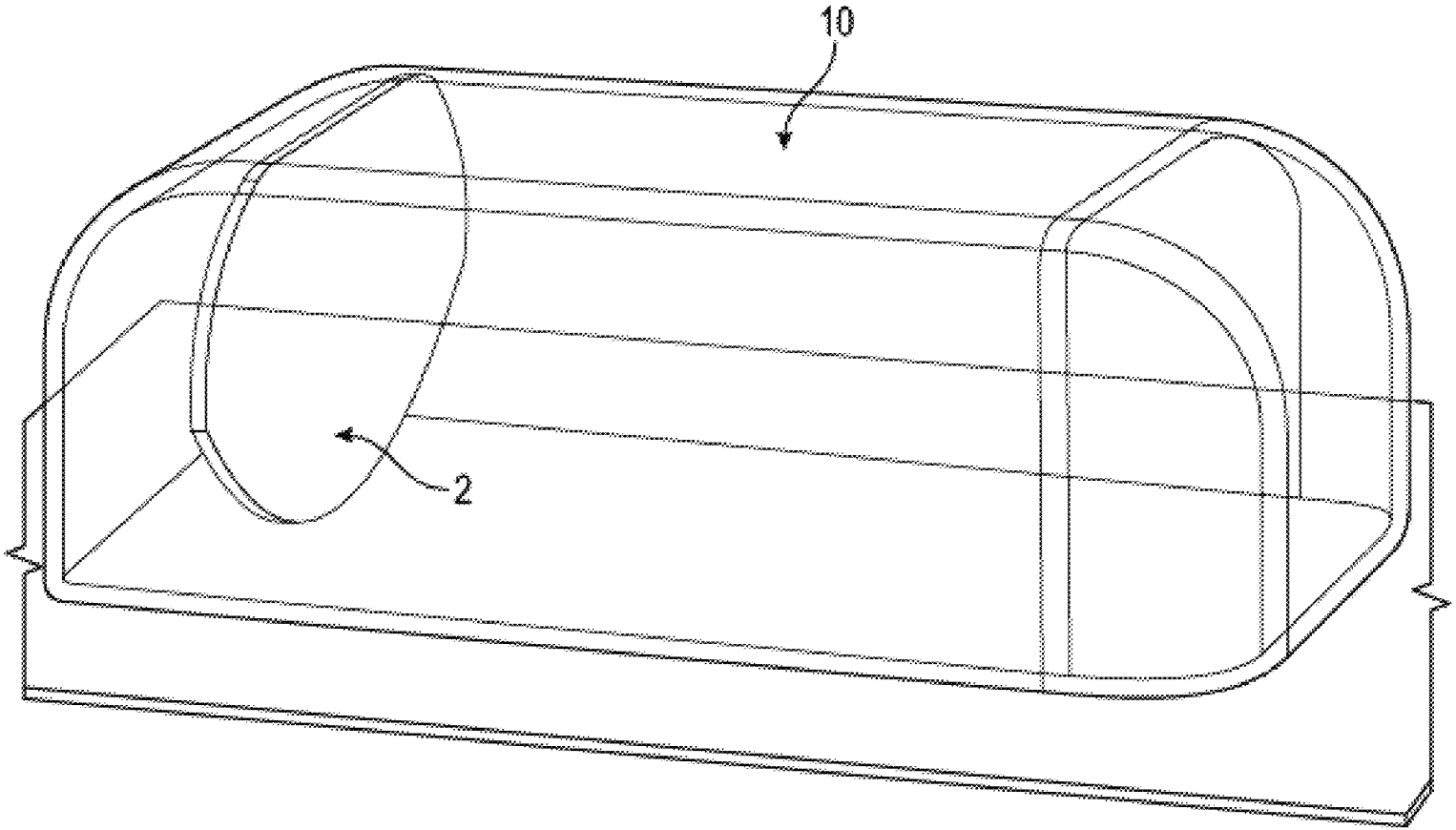
FIG. 7 is a perspective view of an embodiment of an individual compartment that can be used in one or more embodiments of a dispenser or blister pack including an arc shaped piercing member that extends from one side of the compartment to another side of the compartment wherein the sides of the piercing member within the compartment are of uniform thickness with the piercing arc member.
Figure 8:
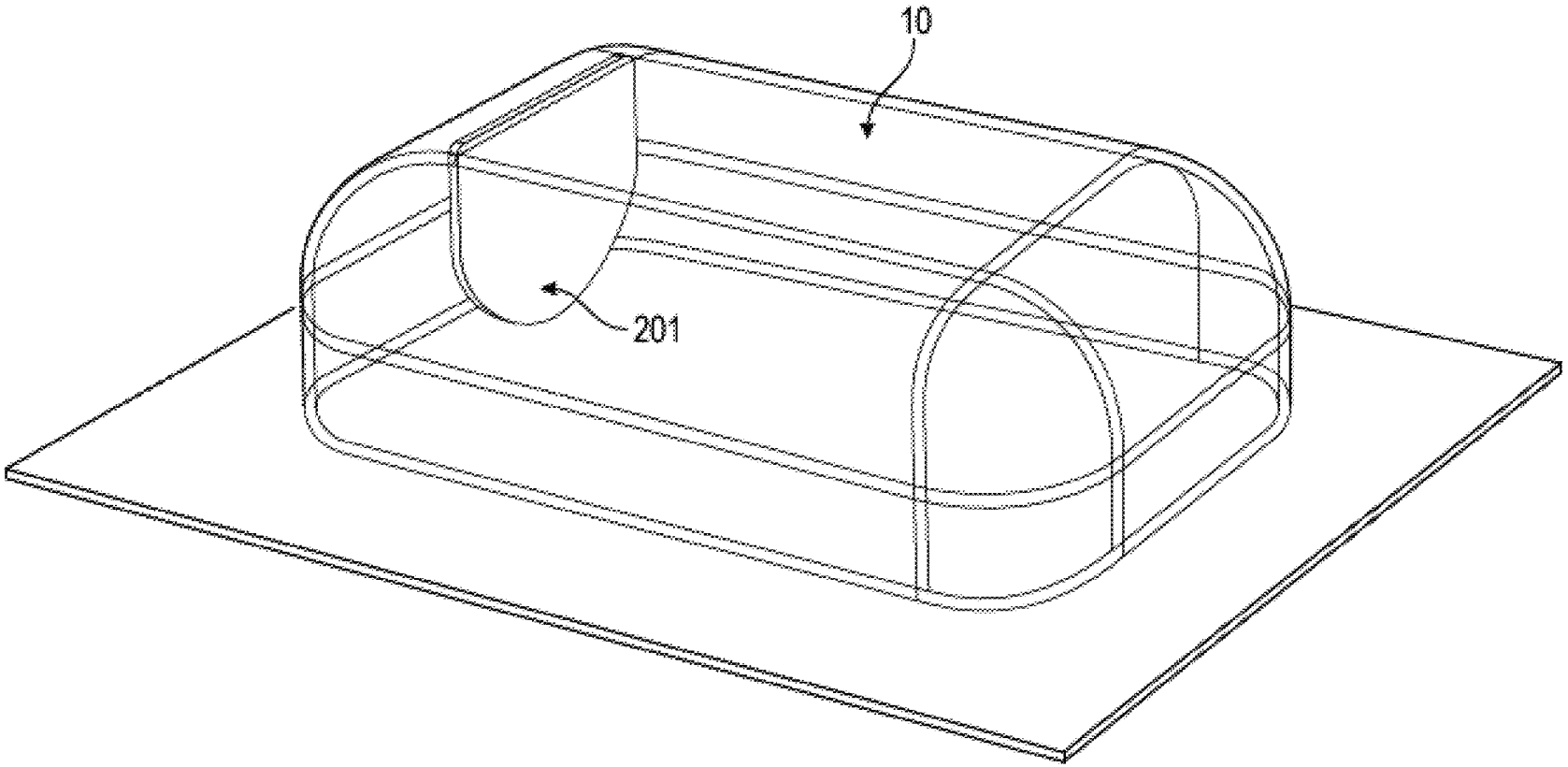
FIG. 8 is a perspective view of an embodiment of an individual compartment that can be included in one or more embodiments of a dispenser or blister pack of the present invention including a shorter arc shaped piercing member that does not extend all the way from one side of the compartment to another side of the compartment.

A dispenser of blister pack 1 can have any desired number of individual compartments 5, 501, 503, e.g., 1, 2, 3, 4, 5, 6, 7, 8, 9, 10, 11, 12, 13, 14, 15, 16, 17, 18, 19, 20 or more individual compartments 5, 501, 503. Preferably a dispenser or blister pack 1 is of size that can easily be coupled to a lanyard 3 or other necklace, e.g., through an opening on the blister pack 1 in an area that is not part of a containment area of an individual compartment 5, 501, 503, and preferably a dispenser or blister pack 1 is of a size that can conveniently be worn by a user. A blister pack 1 can also be coupled to a clip or key chain, for example, that can be coupled to a user's clothing, or to a purse or backpack or other desired bag. For example, FIGS. 6A and 6B show a blister pack 1 with a whole punched 12 through which a clip 301 such as the one shown in FIG. 6C can pass through to secure the blister pack 1.

Figure 3A:
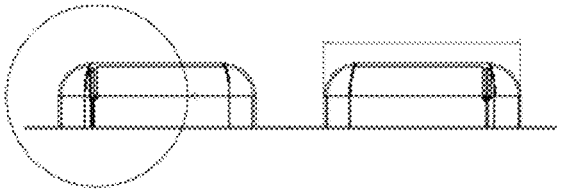
FIG. 3A is a side view of an embodiment of a dispenser or blister pack of the present invention including perforated individual compartments.
Figure 3C:
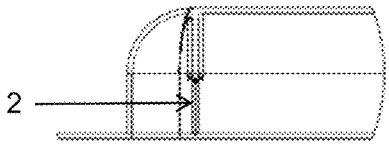
FIG. 3C is a side view of the of the dispenser or blister pack as shown in FIG. 3A.
Figure 3B:
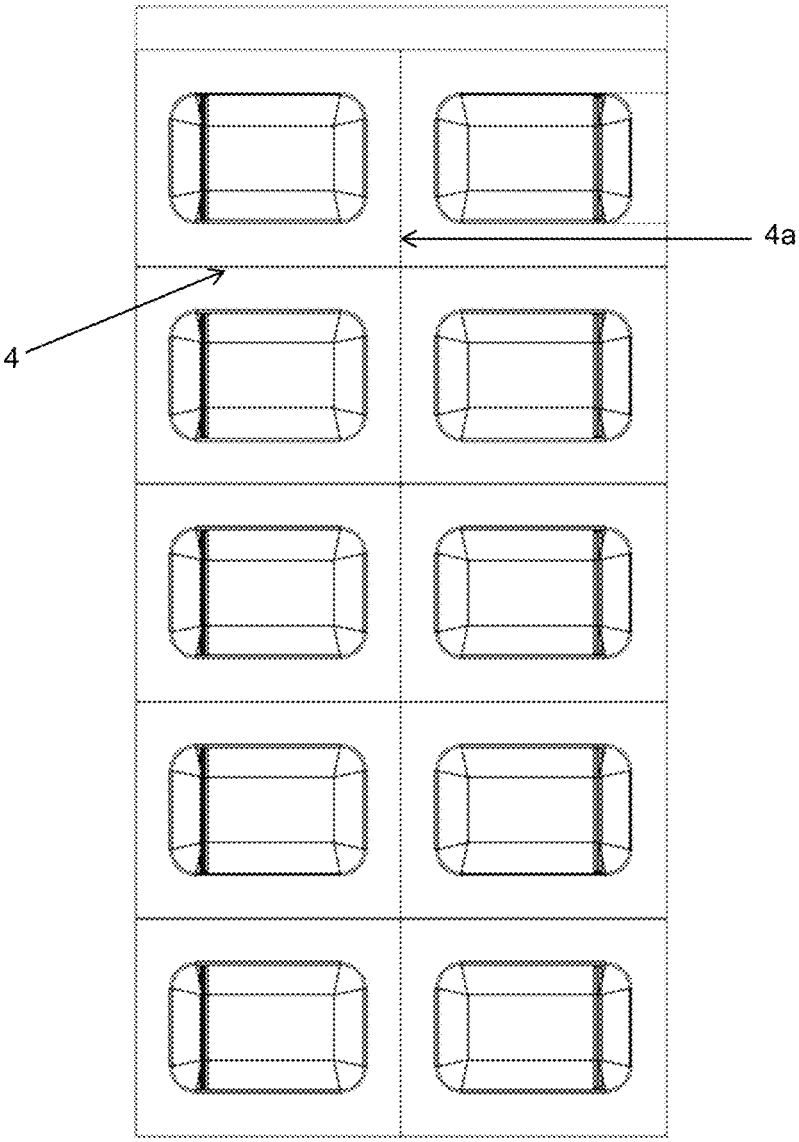
FIG. 3B is a top view of the dispenser or blister pack as shown in FIG. 3A.
Figure 3D:
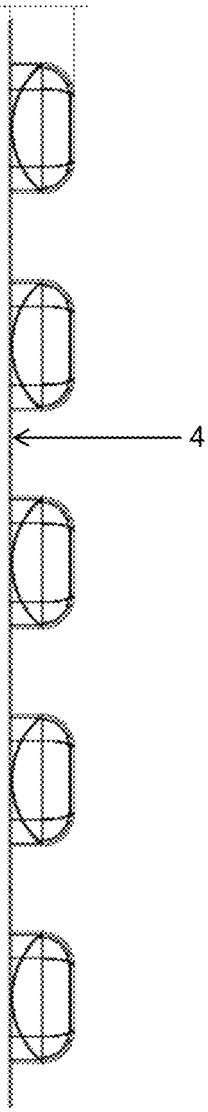
FIG. 3D is another side view of the of the dispenser or blister pack as shown in FIG. 3A.
Figure 3E:
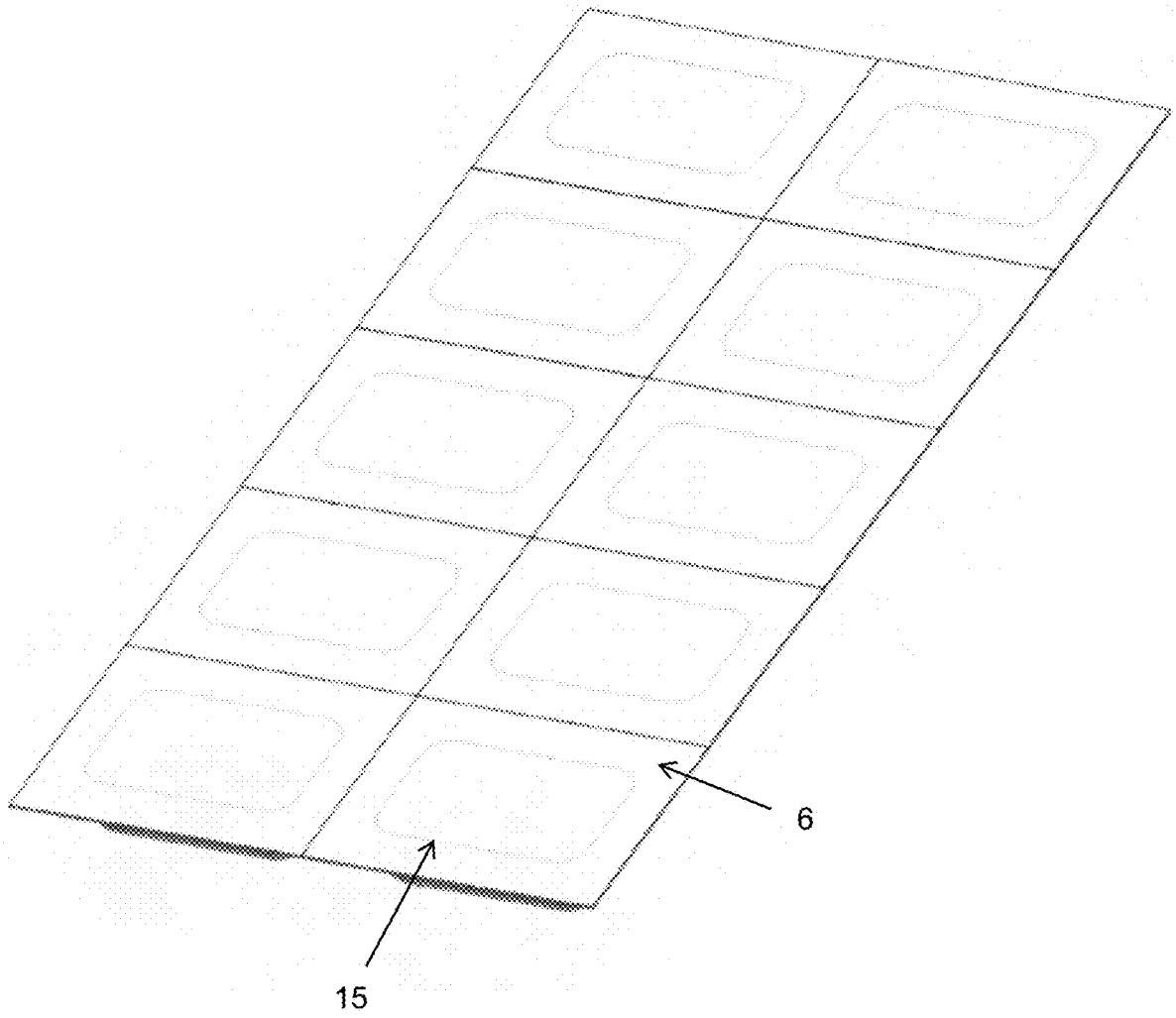
FIG. 3E shows a bottom view of the blister pack shown in FIG. 3A in which the base layer is shown with perforations.
Figure 4A:
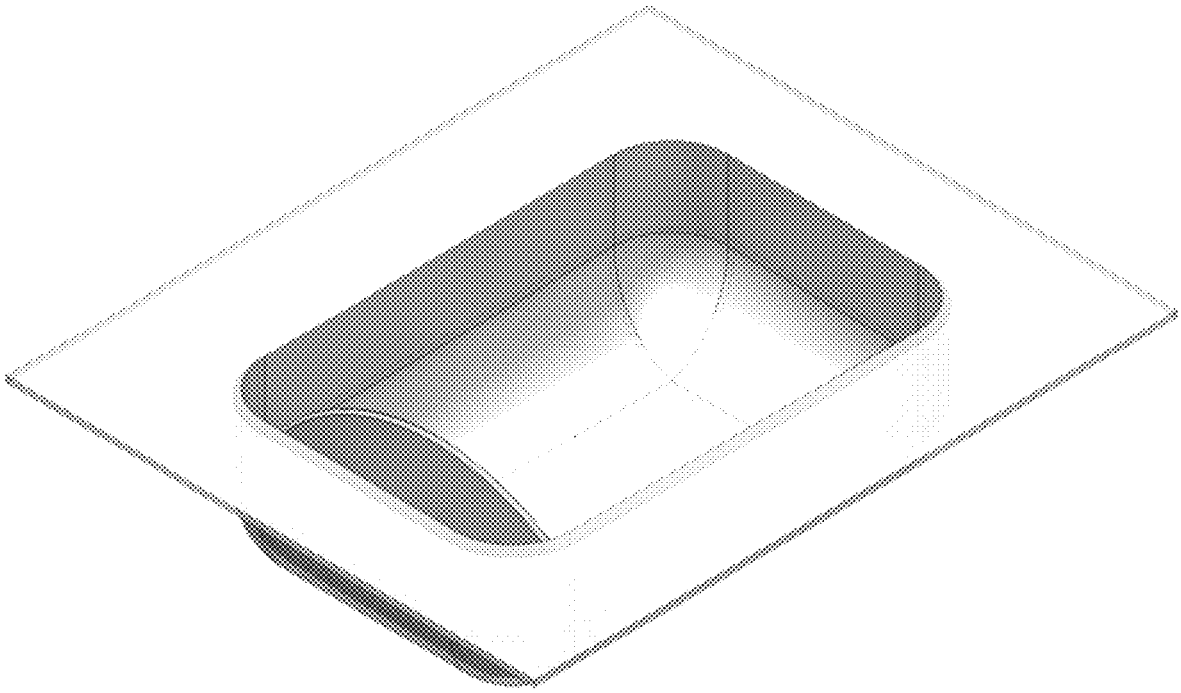
FIG. 4A is a perspective view an embodiment of an individual compartment that can be included in one or more embodiments of a dispenser or blister pack of the present invention, showing the individual compartment open along a bottom portion, and including an arc shaped piercing member extending from one side of the compartment to another side of the compartment with the arc shaped piercing member of about uniform width with the side wall of the compartment.
Figure 4B:
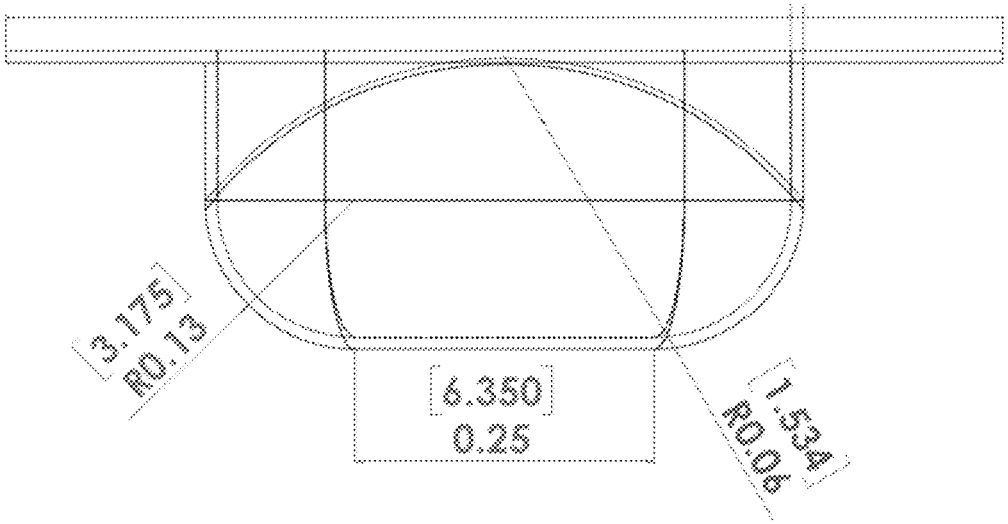
FIG. 4B is a front view of the embodiment in FIG. 4A.
Figure 4C:
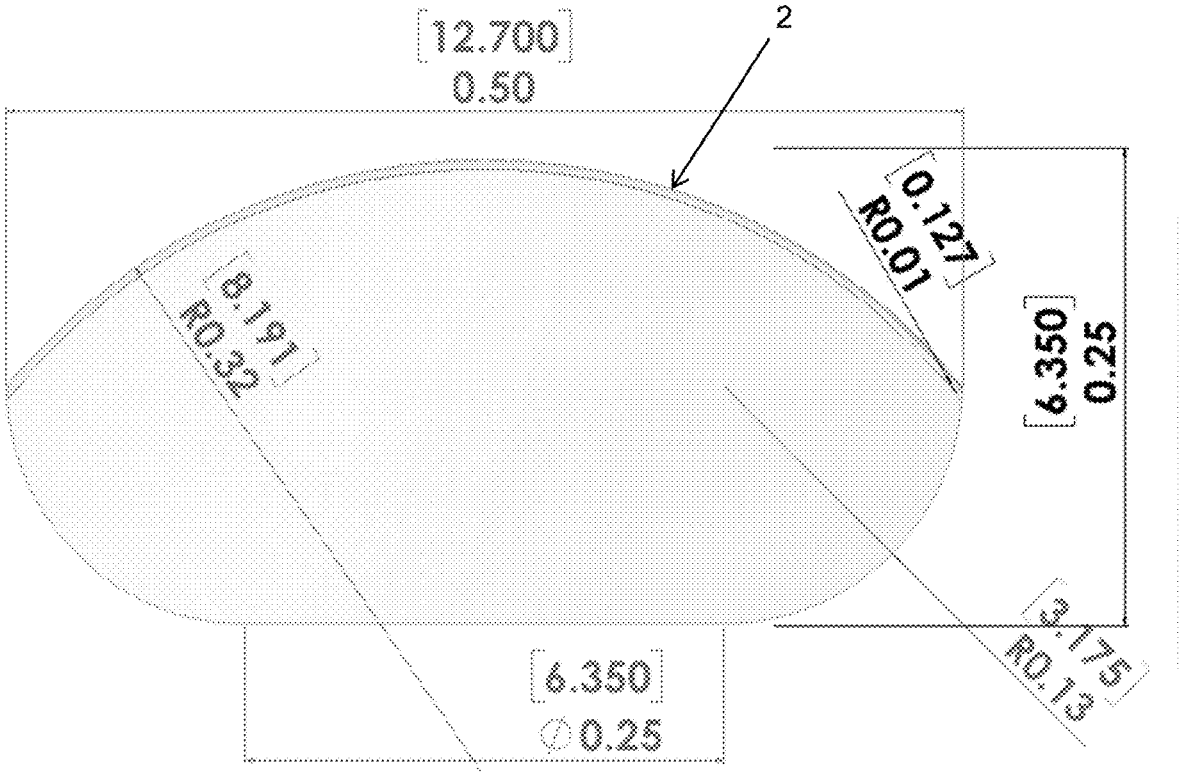
FIG. 4C is a partial detail view of a piercing member of the individual compartment as shown in FIG. 4A.
Figure 4D:
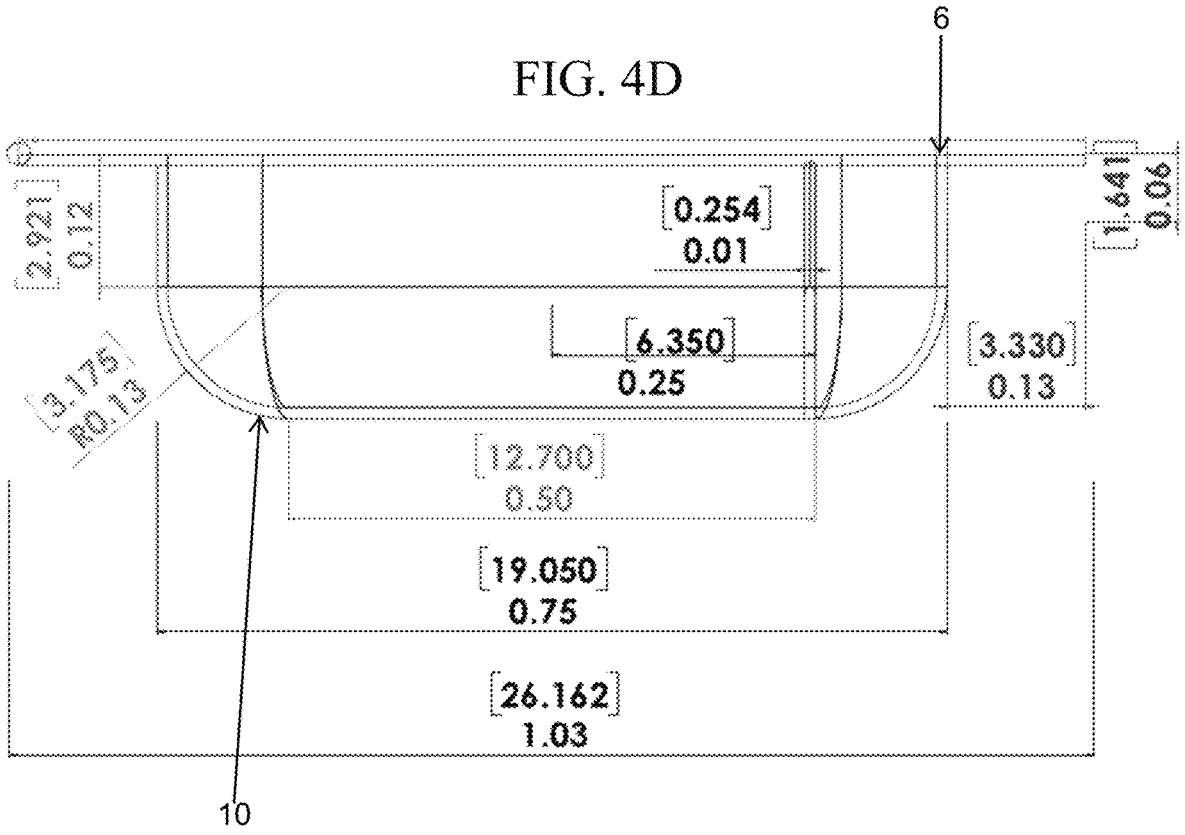
FIG. 4D is a side view of the embodiment in FIG. 4A.
Figure 5A:
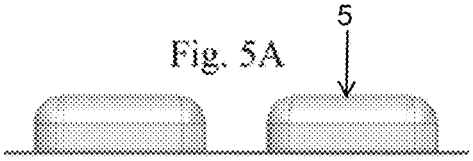
FIG. 5A is a side view of an embodiment of a dispenser or blister pack of the present invention.
Figure 5C:
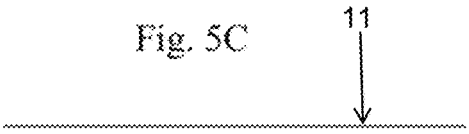
FIG. 5C is a side view of a protective layer on the back of the dispenser or blister pack as shown in FIG. 5A.
Figure 5B:
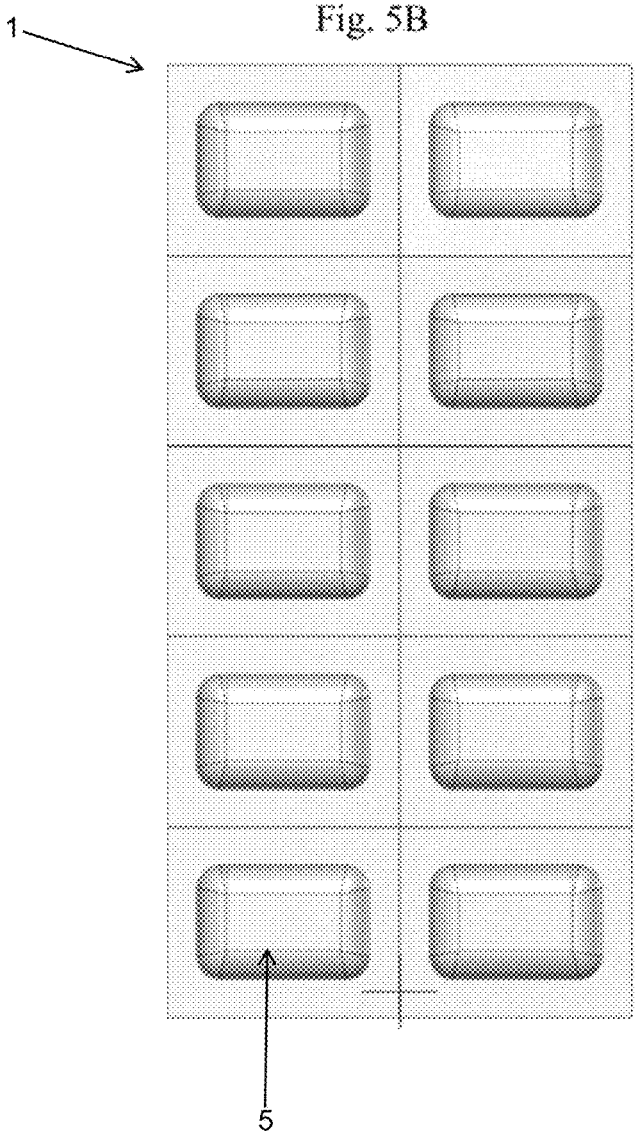
FIG. 5B is a front view of the dispenser or blister pack as shown in FIG. 5A.
Figure 5D:
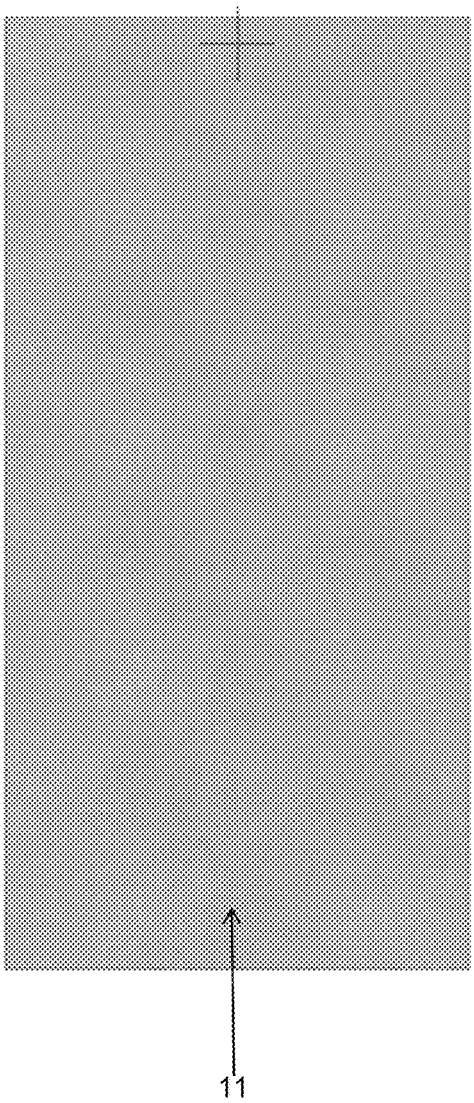
FIG. 5D is a back view of the dispenser or blister pack as shown in FIG. 5A including a top layer without perforations.

As shown in, for example, FIGS. 4A and 4B, an individual compartment 5 has a continuous side wall 9, a top portion 10 and an open area or space 7 between the side wall 9 and top portion 10 that can house a material, e.g., a fluid, gel, or dry flowable material. The blister pack 1 may also have a base layer 6, that extends across the individual compartment 5 bottom opening and may extend as a single sheet across the entire blister pack 1 in order to close the compartment and keep the liquid inside. The base layer 6 may also have perforations 15 as shown in FIG. 3E, which facilitate removal of the base layer 6 when desired.

A compartment 5, 501, 503 can have a depth of 2 to 10 mm, and preferably more or less depending on the application. Preferably there is about 0 to 10 millimeters between a piercing edge of the piercing member (e.g., as shown in FIG. 4A, 4B, element 2) and the base layer 6. More preferably, there is approximately 2-10 millimeters between a piercing edge of the piercing member 2 and the base layer 6. The piercing member 2 can touch the base layer 6 or foil of the lidding material, but it is preferably in most applications for the piercing member 2 to be sized so as not to touch the base layer 6, unless specific pressure is applied, in order to prevent accidental discharge.

In one or more embodiments, the materials used to construct the piercing member and side wall (known as the forming film) can be PVC, polypropylene (PP), polyester (PET), Polyvinylidene chloride (PVDC), PVC/chlorotrifluoroethylene (CTFE), Oriented polyamide (OPA)/aluminum/PVC or nylon/aluminum/PVC, or CTFE homopolymer.

A top layer of material 11, e.g., made of aluminum, paper and aluminum, or paper, PVC, and aluminum can be located on top of the base layer 6 to provide further protection for the blister pack 1. The top layer 11 may be removably attached by peeling. Top layer 11 is preferably coupled to base layer 6 with adhesive, which enables easy removal of this top, protective layer 11. Top layer 11 can prevent inadvertent puncturing or breaking of base layer 6 until it is desired to do so. Protective layer 11 can also be included as a child safety feature.

The top layer 11 may also cover the opposite side of the blister pack 1. In that embodiment, top layer perforations, for example, 4 and 4*a* in FIG. 3B can be included in both the lower top layer 11 and upper top layer, so as to easily be able to separate or remove individual compartments 5, 501, 503 if desired.

The top layer of material 11 preferably completely covers base layer 6 of dispenser or blister pack 1 and closes each compartment 5, 501, 503 so that a desired material can be contained therein. Preferably base layer 6 and top layer 11 are made of a material that can be pierced or broken by a piercing member 2, 201, 301, 401, 501, 601, 701, 801, 901, 202, 302, 402, 502 when it is desired to release a material contained within compartment 5, 501, 503. Preferably material held within a compartment 5, 501, 503 will not pierce or break base layer 6 or top layer 11 on its own.

Base layer 6 and top layer 11 may be aluminum, paper and aluminum, or paper, PVC, and aluminum. In other embodiments, any suitable material known in the art may be used.

FIGS. 3A-3D illustrate an embodiment of an individual compartment 5 that can be included in a dispenser or blister pack 1 of the present invention, with an arc shaped piercing member 2 wherein the arc shaped piercing member 2 extends from one side of the compartment 5 to another side of the compartment 5 and is narrower than the side wall 9 of the compartment 5. Piercing member 2 can be integrally formed with side wall 9 and top portion 10 of compartment 5. A single piece construction is a preferable manner in which to produce the piercing member 2 and side wall construction.

In another embodiment, the piercing member 2 and side wall can be produced by affixing the piercing mechanism preferably with a non-reactive adhesive. Affixing a piercing mechanism by using an adhesive or some other potentially removable mechanism can result in a choking hazard that a single piece construction avoids. This style compartment is to house any and all types of fluids, gels, or dry flowable materials.

FIGS. 4A-4D; 7 illustrate a second embodiment of an individual compartment that can be included in one or more embodiments of a dispenser or blister pack 1 of the present invention, showing the individual compartment 5 open along a bottom or back side, and including an arc shaped piercing member 2 extending from one side of the compartment to another side of the compartment with the arc shaped piercing member 2 having a width that is about uniform with a width of the side walls 9 of the compartment 5. Piercing member 2 can be integrally formed with side wall 9 and top portion 10 of compartment 5 as described above. This style compartment is to house any and all types of fluids, gels, or dry flowable materials.

FIGS. 9A-9F, 8 illustrates an embodiment of an individual compartment 5 that can be included in one or more embodiments of a dispenser or blister pack 1 of the present invention including a shorter arc shaped piercing member 301 that does not extend all the way from one side of the compartment to another side of the compartment. Piercing member 301 can be integrally formed with side wall 9 and top portion 10 of compartment 5, or just integrally formed with top portion 10 as described above. This style compartment is to house any and all types of fluids, gels, or dry flowable materials.

Figure 9G:
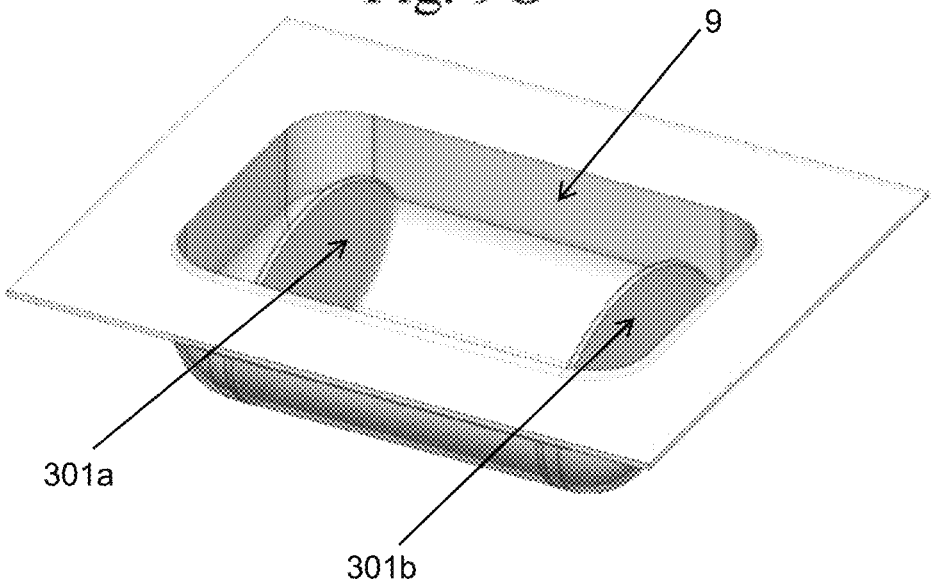
FIG. 9G is a perspective view of an embodiment of an individual compartment that can be used with one or more embodiments of a dispenser or blister pack of the present invention, wherein the individual compartment includes two arc shaped piercing members within the individual compartment.
Figure 10A:
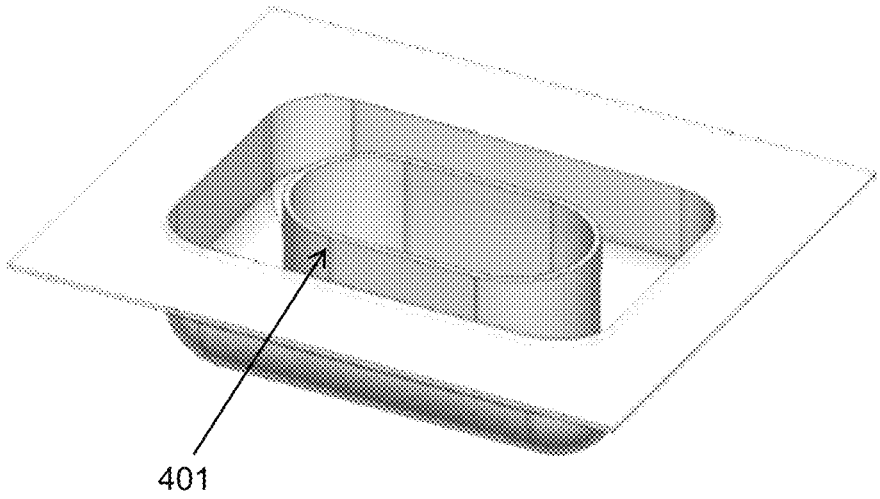
FIG. 10A is a perspective view of a sixth embodiment of an individual compartment that can be used in one or more embodiments of a dispenser or blister pack of the present invention that includes an oval-shaped piercing member within the individual compartment.
Figure 10B:
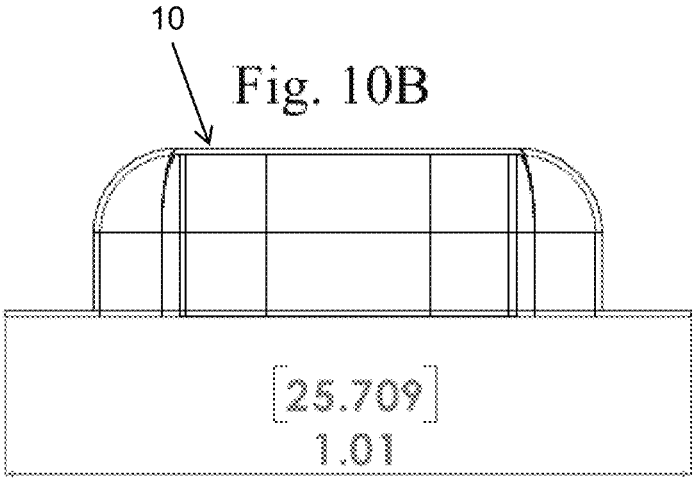
FIG. 10B is a side view of the compartment as shown in FIG. 10A.
Figure 10C:
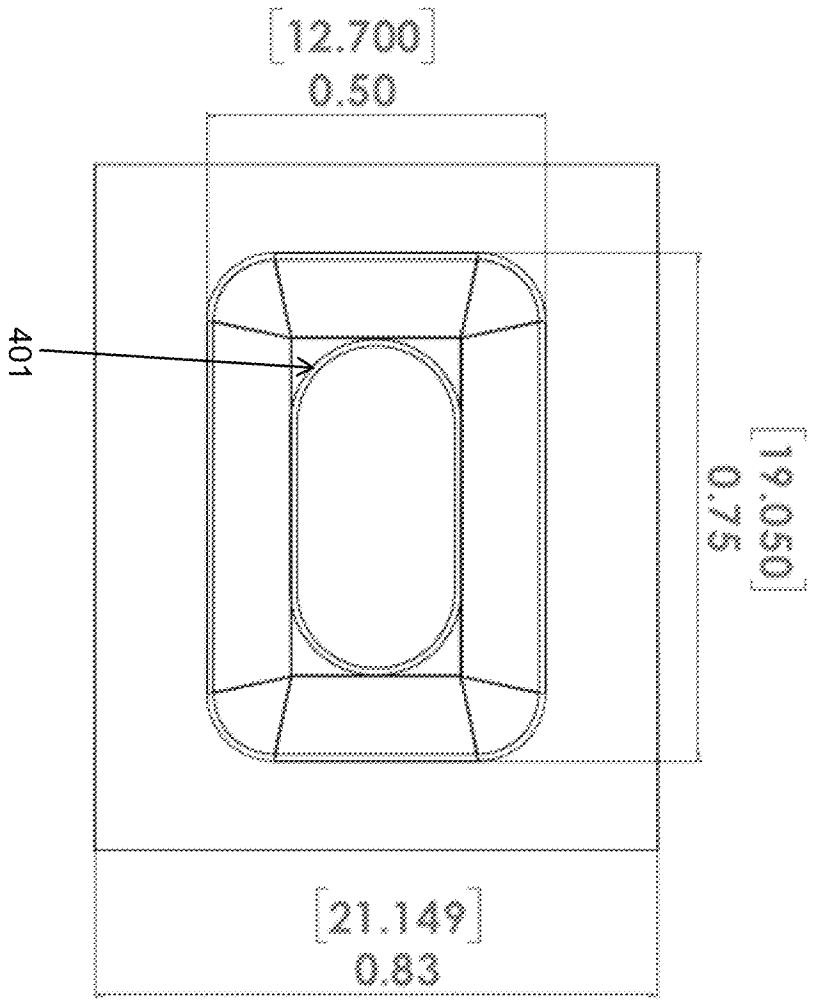
FIG. 10C is a top view of the compartment as shown in FIG. 10A.
Figure 10D:
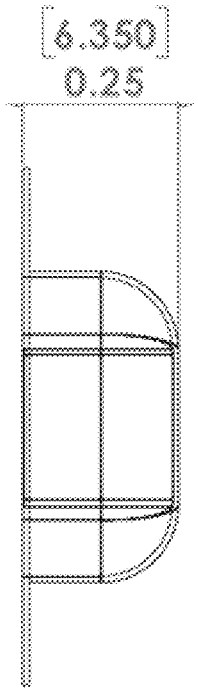
FIG. 10D is another side view of the compartment as shown in FIG. 10A.
Figure 10E:
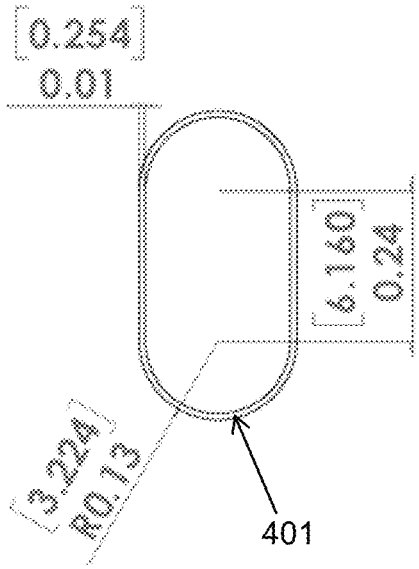
FIG. 10E is a bottom view of the piercing member of the compartment as shown in FIG. 10A.
Figure 10F:
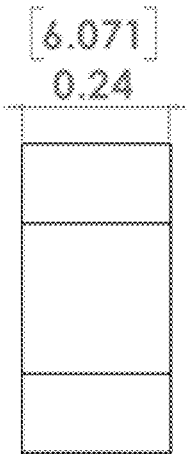
FIG. 10F is a side view of the piercing member of the compartment as shown in FIG. 10A.
Figure 11A:
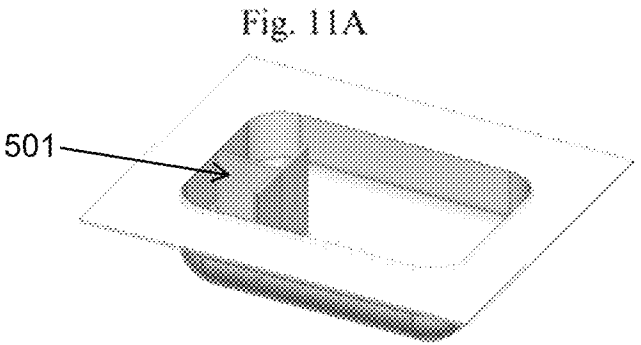
FIG. 11A is a perspective view of an embodiment of an individual compartment that can be included in one or more embodiments of a dispenser or blister pack of the present invention that includes a T-shaped piercing member within the compartment.
Figure 11B:
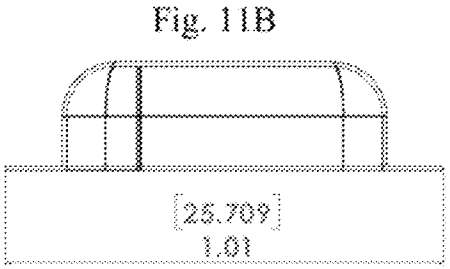
FIG. 11B is a side view of the compartment as shown in FIG. 11A.
Figure 11C:
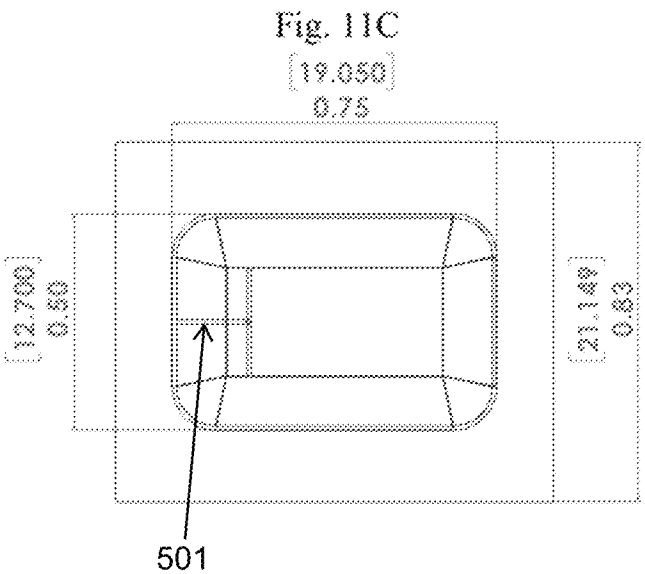
FIG. 11C is a top view of the compartment as shown in FIG. 11A.
Figure 11D:
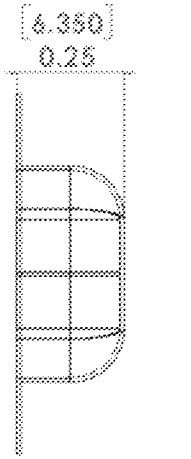
FIG. 11D is another side view of the compartment as shown in FIG. 11A.
Figure 11E:
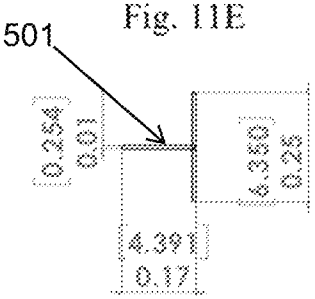
FIG. 11E is a bottom view of the piercing member of the compartment as shown in FIG. 11A.
Figure 11F:
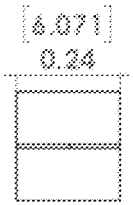
FIG. 11F is a forward side view of the piercing member of the compartment as shown in FIG. 11A.
Figure 12A:
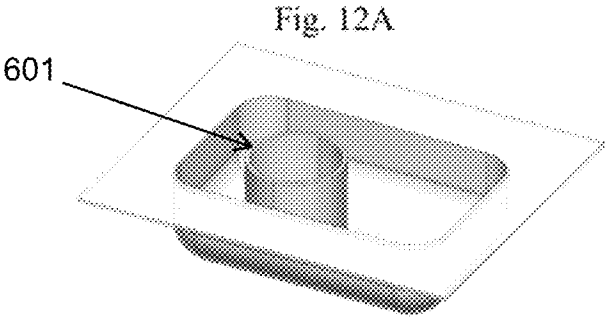
FIG. 12A is a perspective view of an embodiment of an individual compartment that can be included in one or more embodiments of a dispenser or blister pack of the present invention that includes a circular-shaped piercing member within the compartment.
Figure 12B:
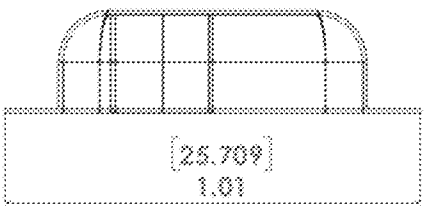
FIG. 12B is a longitudinal side view of the compartment as shown in FIG. 12A.
Figure 12C:
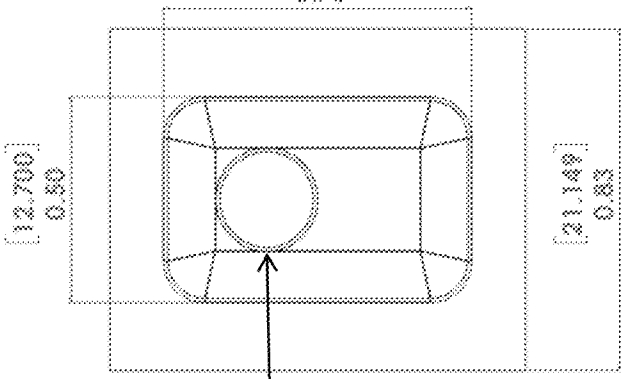
FIG. 12C is a top view of the compartment as shown in FIG. 12A.
Figure 12D:
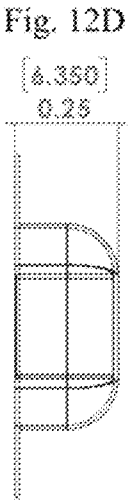
FIG. 12D is another side view of the compartment as shown in FIG. 12A.
Figure 12E:
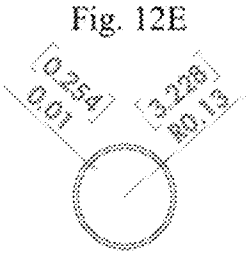
FIG. 12E is a bottom view of the piercing member of the compartment as shown in FIG. 12A.
Figure 12F:
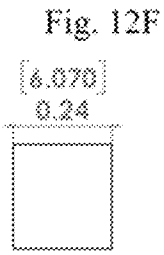
FIG. 12F is a forward side view of the piercing member of the compartment as shown in FIG. 12A.
Figure 13A:
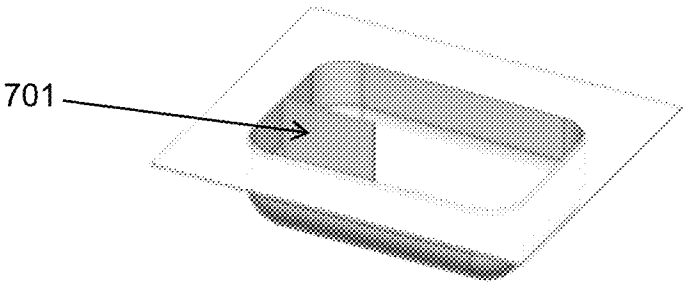
FIG. 13A is a perspective view of an embodiment of an individual compartment that can be included in one or more embodiments of a dispenser or blister pack of the present invention that includes a linear shaped piercing member extending from one side wall longitudinally into the compartment.
Figure 13E:
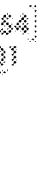
FIG. 13E is a partial detail view of the piercing member as shown in FIG. 13A.
Figure 13D:
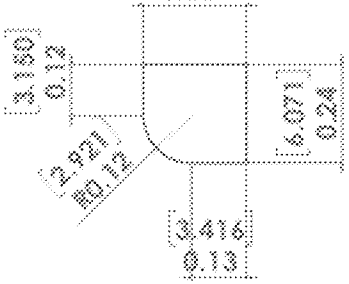
FIG. 13D is another side view of the compartment as shown in FIG. 13A.
Figure 13C:
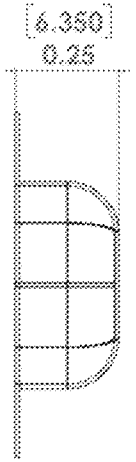
FIG. 13C is a top view of the compartment as shown in FIG. 13A.
Figure 13B:
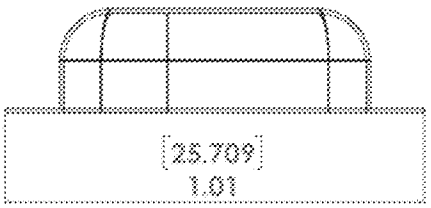
FIG. 13B is a longitudinal side view of the compartment as shown in FIG. 13A.
Figure 13F:
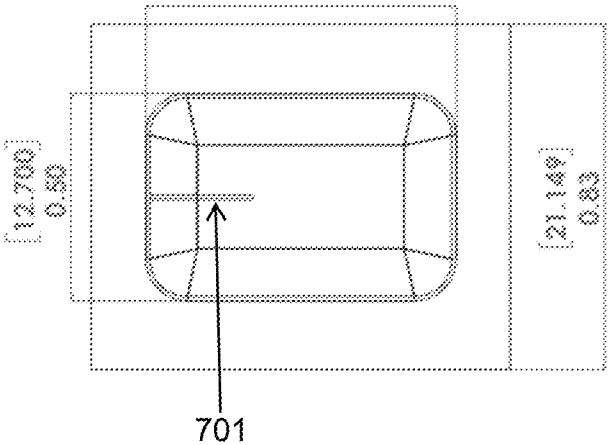
FIG. 13F is a side view of the piercing member of the compartment as shown in FIG. 13A.
Figure 14A:
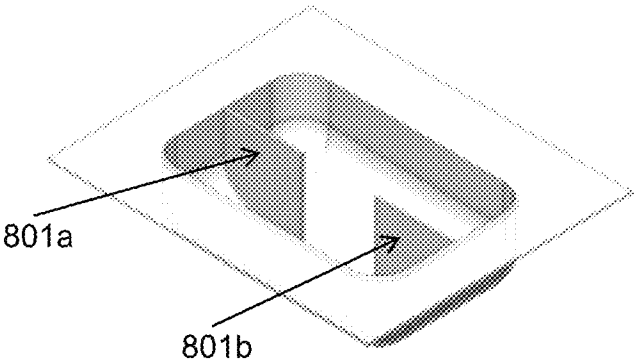
FIG. 14A is a perspective view of an eleventh embodiment of an individual compartment that can be included in one or more embodiments of a dispenser or blister pack of the present invention that includes two linear shaped piercing members, each extending from a side of the compartment longitudinally within the compartment.
Figure 14E:
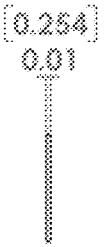
FIG. 14E is a side view of one of the piercing members of the compartment as shown in FIG. 14A.
Figure 14D:
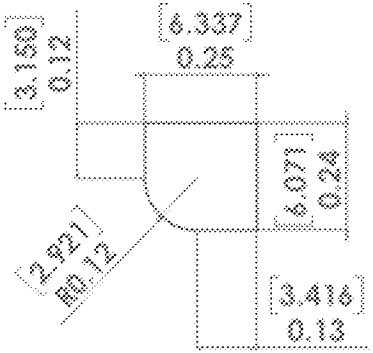
FIG. 14D is a partial detail view of one of the piercing members of the compartment as shown in FIG. 14A.
Figure 14C:
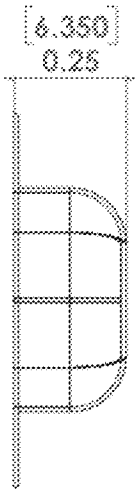
FIG. 14C is another side view of the compartment as shown in FIG. 14A.
Figure 14B:
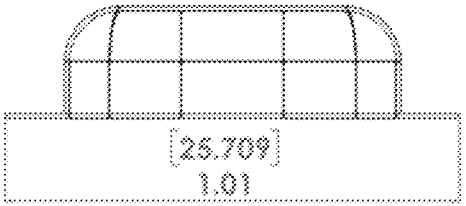
FIG. 14B is a side view of the compartment as shown in FIG. 14A.
Figure 14F:
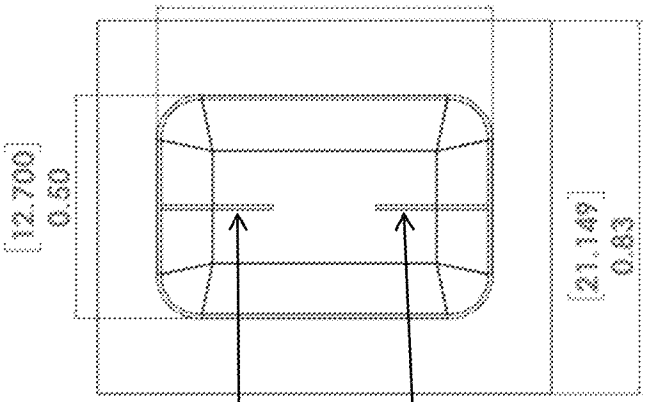
FIG. 14F is a top view of the compartment as shown in FIG. 14A.
Figure 15A:
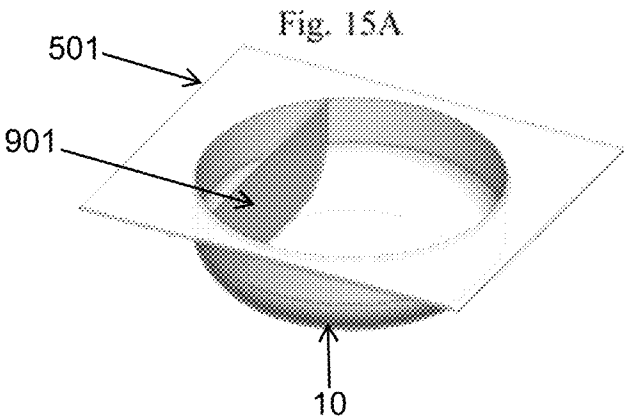
FIG. 15A is a perspective view of an embodiment of an individual compartment that can be included in one or more embodiments of a dispenser or blister pack of the present invention wherein the compartment is circular and includes a linear shaped piercing member extending laterally across the compartment from one side of the compartment to another side of the compartment.
Figure 15B:
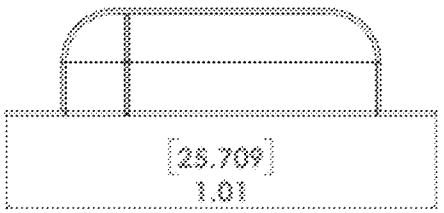
FIG. 15B is a longitudinal side view of the compartment as shown in FIG. 15A.
Figure 15C:
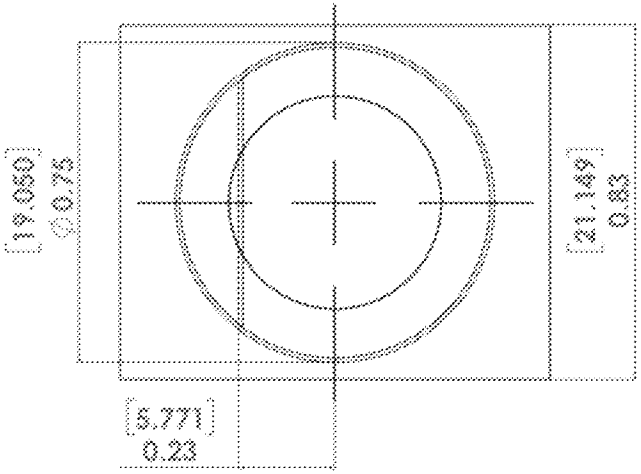
FIG. 15C is a top view of the compartment as shown in FIG. 15A.
Figure 15D:
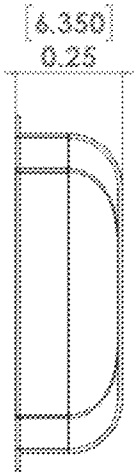
FIG. 15D is another side view of the compartment as shown in FIG. 15A.
Figure 15E:
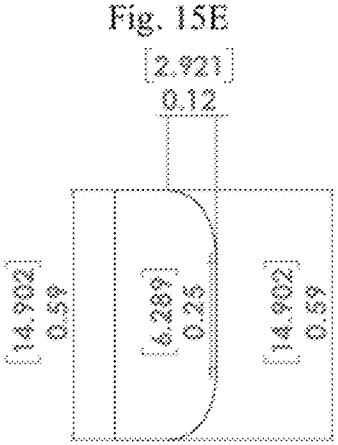
FIG. 15E is a partial detail view of the piercing member of the compartment as shown in FIG. 15A.
Figure 15F:
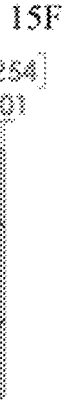
FIG. 15F is a side view of the piercing member of the compartment as shown in FIG. 15A.
Figure 16A:
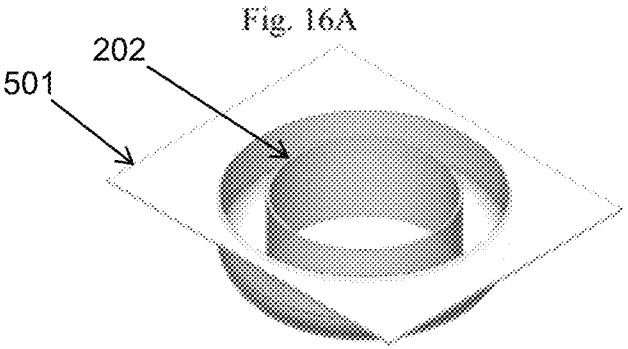
FIG. 16A is a perspective view of an embodiment of an individual compartment that can be included in one or more embodiments of a dispenser or blister pack of the present invention wherein the compartment is circular and includes a circular shaped piercing member.
Figure 16B:
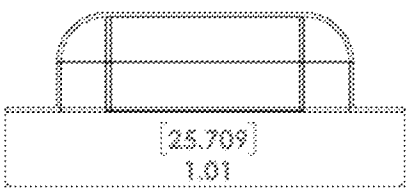
FIG. 16B is a longitudinal side view of the compartment as shown in FIG. 16A.
Figure 16C:
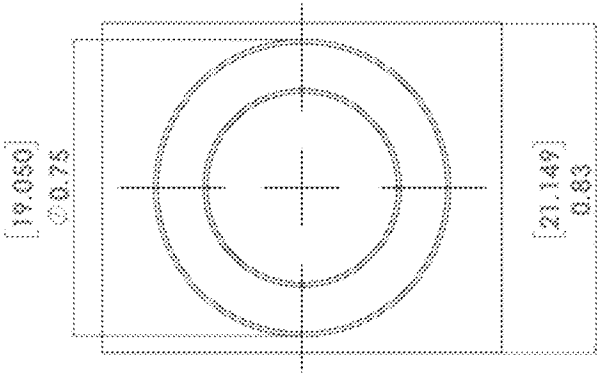
FIG. 16C is a top view of the compartment as shown in FIG. 16A.
Figure 16D:
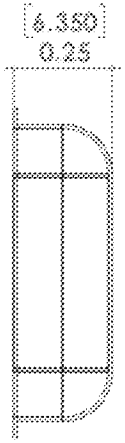
FIG. 16D is another side view of the compartment as shown in FIG. 16A.
Figure 16E:
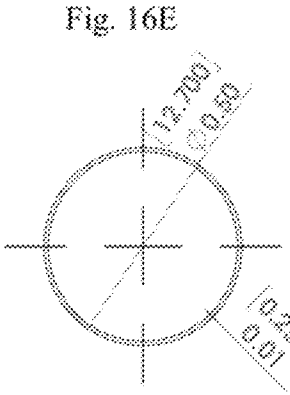
FIG. 16E is a bottom view of the piercing member as shown in FIG. 16A.
Figure 16F:
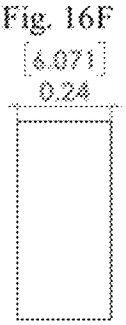
FIG. 16F is a side view of the piercing member of the compartment as shown in FIG. 16A.

FIG. 9G illustrates an embodiment of an individual compartment 5 that can be used with one or more embodiments of a dispenser or blister pack 1 of the present invention that includes two arc shaped piercing members 301 within the individual compartment 5. Although pictured as arc piercing member 301 in shape and size, the shaped piercing members 301 can be a piercing member shaped in any manner described herein. Each piercing member 301 can be integrally formed with side wall 9 and top portion 10 of compartment 5, integrally formed with top portion 10 as described above. This style compartment is to house any and all types of fluids, gels, or dry flowable materials.

FIGS. 10A-10F illustrate an embodiment of an individual compartment 5 that can be used in one or more embodiments of a dispenser or blister pack 1 of the present invention that includes an oval-shaped piercing member 401 within the individual compartment 5. Piercing member 401 can be integrally formed with a top portion 10 of compartment 5 as described above This style compartment is to house any and all types of fluids, gels, or dry flowable materials.

FIGS. 11A-11F illustrate an embodiment of a compartment 5 that can be included in one or more embodiments of a dispenser or blister pack 1 of the present invention that includes a t-shaped piercing member 501 within the compartment 5. Piercing member 501 can be integrally formed with a top portion 10 and side wall 9 of compartment 5 as described above. This style compartment is to house any and all types of fluids, gels, or dry flowable materials.

FIGS. 12A-12F illustrate an embodiment of a compartment 5 that can be included in one or more embodiments of a dispenser or blister pack 1 of the present invention that includes a circular-shaped piercing member 601 within the compartment 5. Piercing member 601 can be integrally formed with a top portion 10 of compartment 5 as described above. This style compartment is to house any and all types of fluids, gels, or dry flowable materials.

FIGS. 13A-13F illustrate an embodiment of a compartment 5 that can be included in one or more embodiments of a dispenser or blister pack 1 of the present invention that includes a linear shaped piercing member 701 extending from side wall 9 a distance longitudinally into the open area or space 19 of compartment 5. Piercing member 701 can be integrally formed with a top portion 10 and side wall 9 of compartment 5, integrally formed with top portion 10 as described above. This style compartment is to house any and all types of fluids, gels, or dry flowable materials.

FIGS. 14A-14F illustrate an embodiment of a compartment that can be included in one or more embodiments of a dispenser or blister pack 1 of the present invention that includes two linear shaped piercing members 801*a*, 801*b*, each extending from one side of the compartment longitudinally into open area or space 19 within the compartment 5. The piercing members 801*a*, 801*b* can be integrally formed with a top portion 10 and side wall 9 of compartment 5, integrally formed with a top portion 14 as described above. This style compartment is to house any and all types of fluids, gels, or dry flowable materials.

FIGS. 15A-15F illustrate an embodiment of a compartment 501 that can be included in one or more embodiments of a dispenser or blister pack 1 of the present invention wherein the compartment 501 is circular and includes a linear shaped piercing member 901 extending laterally across the compartment 501 from one side of the compartment 501 to another side of the compartment. The piercing member 901 can be integrally formed with a top portion 10 and side wall 9 of compartment 5 as described above.

FIGS. 16A-16F illustrate an embodiment of a compartment 501 that can be included in one or more embodiments of a dispenser or blister pack 1 of the present invention wherein the compartment 501 is circular and includes a circular shaped piercing member 202. The piercing member 202 can be integrally formed with a top portion 10 of compartment 501 as described above.

Figure 17B:
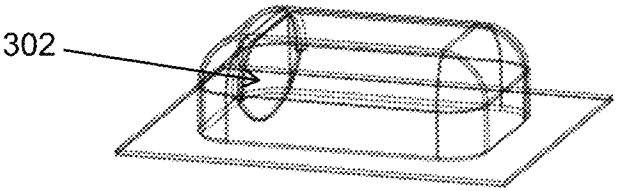
FIG. 17B is a prospective view of the compartment in FIG. 17A.
Figure 17A:
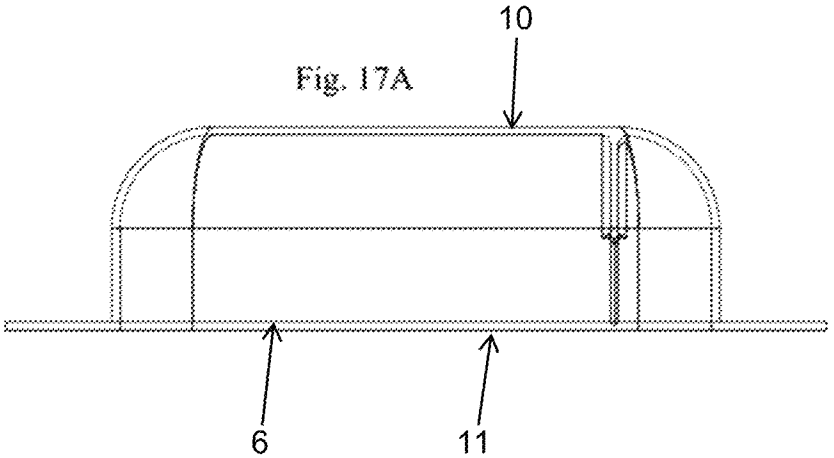
FIG. 17A is a side view of an embodiment of an individual compartment that can be included in one or more embodiments of a dispenser or blister pack of the present invention wherein the compartment includes a circular shaped piercing member.

FIGS. 17A, 17B illustrate an embodiment of a compartment 5 that can be included in one or more embodiments of a dispenser or blister pack 1 of the present invention wherein the compartment 5 includes a circular shaped piercing member 302 where the piercing member spans the entire length of the depth of the compartment 5. The piercing member 302 can be integrally formed with a top portion 10 of compartment 5 as described above.

Figure 18B:
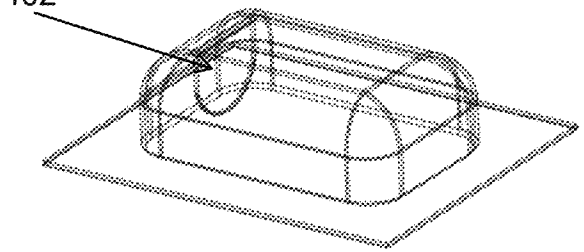
FIG. 18B is a perspective view of the compartment in FIG. 17A.
Figure 18A:
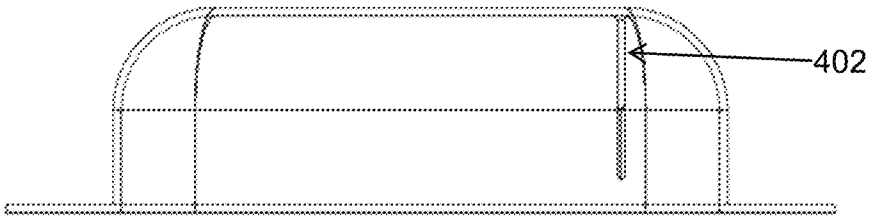
FIG. 18A is a side view of an embodiment of an individual compartment that can be included in one or more embodiments of a dispenser or blister pack of the present invention wherein the compartment includes a circular shaped piercing member where the piercing member does not span the entire length of the depth of the compartment.
Figure 19A:
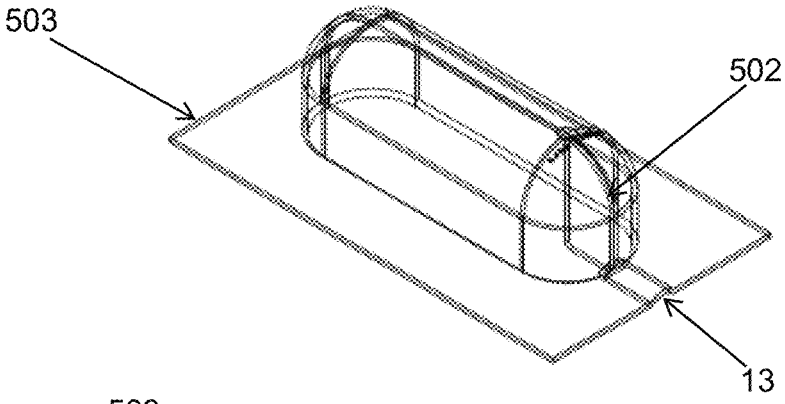
FIG. 19A is a perspective view of an embodiment of an individual compartment that can be included in one or more embodiments of a dispenser or blister pack of the present invention wherein the compartment comprises a slit through which liquid can flow.
Figure 19B:
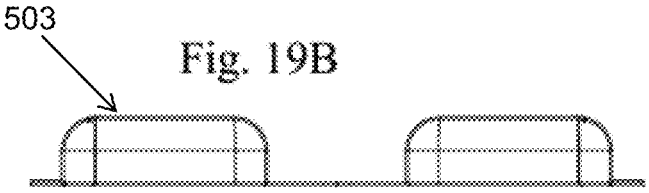
FIG. 19B is a side view of a dispenser or blister pack with the compartment of FIG. 19A.
Figure 19C:
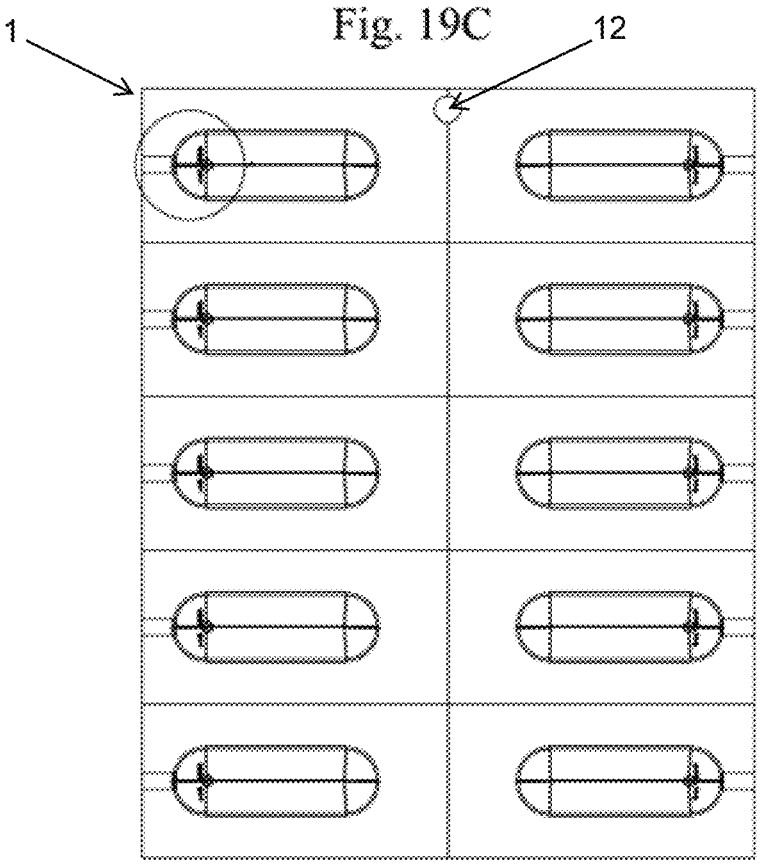
FIG. 19C is a top view of a dispenser or blister pack with the compartment of FIG. 19A.
Figure 19D:
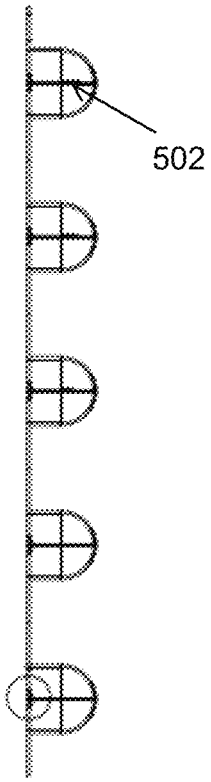
FIG. 19D is another side view of a dispenser or blister pack with the compartment of FIG. 19A, which shows a detail of the piercing member.
Figure 21A:
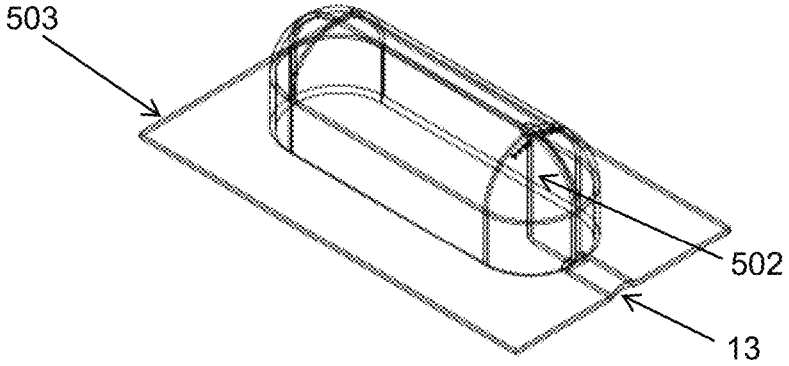
FIG. 21A is a perspective view of an embodiment of an individual compartment that can be included in one or more embodiments of a dispenser or blister pack of the present invention wherein the compartment comprises a slit through which liquid can flow and wherein the blister pack or dispenser comprises a center raised console opposite the top of the compartments.
Figure 21B:
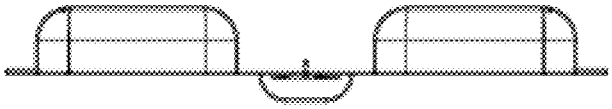
FIG. 21B is a side view of a dispenser or blister pack with the compartment of FIG. 21A.
Figure 21C:
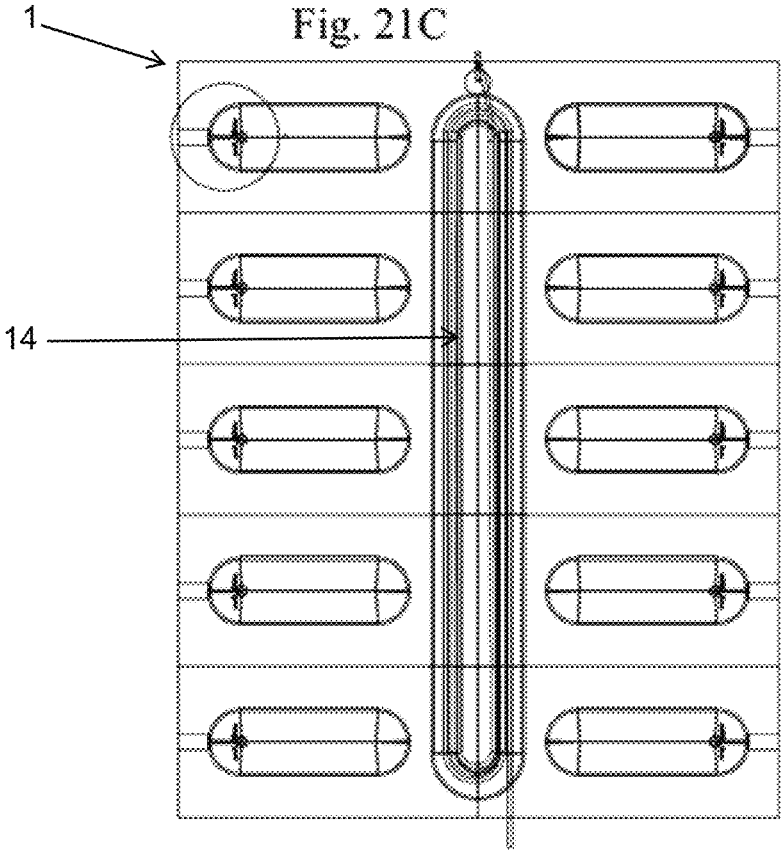
FIG. 21C is a top view of a dispenser or blister pack with the compartment of FIG. 21A.
Figure 21D:
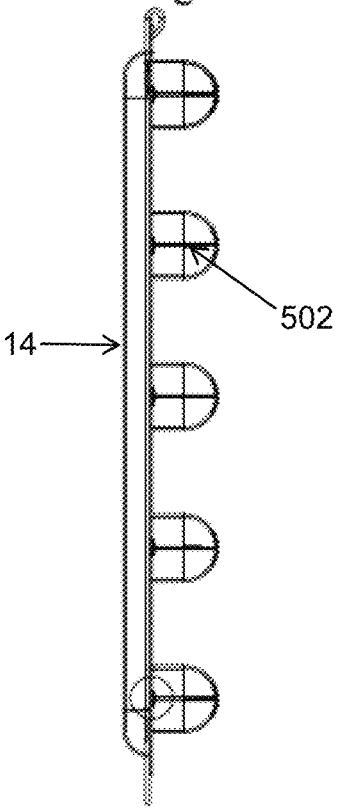
FIG. 21D is another side view of a dispenser or blister pack with the compartment of FIG. 21A, which shows a detail of the piercing member.

FIGS. 18A, 18B illustrate an embodiment of a compartment 5 that can be included in one or more embodiments of a dispenser or blister pack 1 of the present invention wherein the compartment 5 includes a circular shaped piercing member 402 where the piercing member does not span the entire length of the depth of the compartment 5. The piercing member 402 can be integrally formed with a top portion 10 of compartment 5 as described above.

FIGS. 19A-19D illustrate an embodiment of compartment 503 that can be included in one or more embodiments of a dispenser or blister pack 1 of the present invention wherein the compartment 503 is elongated and pill-shaped. The compartment 503 further comprises a slit compartment 13 which is in communication with the piercing member 502. As shown in FIGS. 19A-D, the piercing member 502 is a longitudinal fin shape. When the pressure is applied and the piercing member 502 is activated, it creates an opening in the slit compartment only so that fluid or fluid like materials flow only there the slit compartment 13.

FIGS. 20A-20D illustrate a similar embodiment to that of 19A-19D, except that the compartment 501 is square with rounded edges and the piercing member 602 is shaped like an arc.

FIGS. 21A-21D illustrate an embodiment similar to that of FIGS. 19A-19D, except that the blister pack or dispenser 1 further comprises a center raised console 14 opposite the top of the compartments.

As can be seen from the drawings, a wide variety of different types of piercing members 2 (or piercing plates) can be included in individual compartments 5, 501, 503 of a dispenser or blister pack 1 of the present invention. Other desired shapes and sizes of piercing plates or piercing members (e.g., 2) can also be included in a compartment 5, 501, 503. A piercing member (e.g., 2) can be integrally formed with some part of an individual compartment 5, 501, 503, e.g., so that it is fixed within a compartment 5, 501, 503 and extends into open area or space 7 of a compartment 5, 501, 503 from a top portion 10 or a side wall 9, or from both a top portion 10 or a side wall 9. Preferably a piercing member (e.g., 2) is of a size, shape and material that allows it to pierce or break through a base layer 6 when pressure is applied to base layer 6 in an area over the piercing member 2.

For the purpose of understanding the Wearable Pressure Controlled Release Dispenser, references are made in the text to exemplary embodiments of a Wearable Pressure Controlled Release Dispenser, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

The invention claimed is:

1. A dispenser comprising:

a. at least one compartment having a continuous side wall, a top portion, a piercing member fixed within said compartment, wherein the compartment is adapted to house a fluid, gel, or dry flowable material in at least a portion of the space between said side wall and said top portion;

b. a base layer of material that defines a bottom portion of said compartment and prevents the fluid from exiting said compartment until said base layer is broken or pierced;

wherein when pressure is applied to said base layer in an area over the piercing member, said piercing member pierces said base layer creating an opening in the base layer to access said fluid within said compartment.

2. The dispenser of claim 1 wherein said piercing member has an arc shape.

3. The dispenser of claim 1 wherein said piercing member has a T-shape, an oval shape, linear shape, or a circular shape.

4. The dispenser of claim 1 wherein said piercing member is formed integrally with said top portion of said compartment and extends partially into said compartment.

5. The dispenser of claim 1 wherein said piercing member is formed integrally with said side wall and said top portion of said compartment and extends at least partially laterally across said compartment.

6. The dispenser of claim 1 comprising a plurality of compartments.

7. The dispenser of claim 6 wherein each of said plurality of compartments house a single use application of the fluid.

8. The dispenser of claim 6 wherein each said plurality of compartments is attached to at least one other said compartment such that said fluid in each compartment cannot migrate to another said compartment and wherein each of said plurality of compartments comprises perforations around a periphery of each compartment.

9. The dispenser of claim 1 further comprising a top layer of material that requires more force to pierce than said base layer.

10. The dispenser of claim 1 wherein the piercing member has a continuous piercing member side wall with a periphery, and wherein a first fluid is contained within the periphery of the continuous piercing member side wall and wherein a second fluid is contained within the compartment outside of the periphery of the continuous piercing member side wall.

11. A dispenser comprising a plurality of individual compartments, each compartment comprising a continuous side wall, a top portion, a base layer, and a piercing member; wherein said top portion and said continuous side wall are integrated so as to form a hollow opening; wherein said piercing member is located within said hollow opening so as to be near said base layer but not in contact with said base layer; wherein each of said plurality of compartments is adapted to hold an individual dose of liquid or gel; wherein said individual dose is accessed by external pressure applied to said base layer at the approximate location of said piercing member; and wherein said plurality of said individual compartments are connected through a top layer, wherein said top layer comprises perforations which allow said plurality of individual compartments to be separated from one another without releasing said liquid or gel.

* * * * *